US008250964B2

(12) United States Patent
Stone

(10) Patent No.: US 8,250,964 B2
(45) **Date of Patent: *Aug. 28, 2012**

(54) GAS SYSTEM FOR FIREARMS

(75) Inventor: Jeffrey W. Stone, ElizabethTown, KY (US)

(73) Assignee: RA Brands, L.L.C., Madison, NC (US)

( * ) Notice: Subject to any disclaimer, the term of this patent is extended or adjusted under 35 U.S.C. 154(b) by 118 days.

This patent is subject to a terminal disclaimer.

(21) Appl. No.: 12/818,291

(22) Filed: Jun. 18, 2010

(65) Prior Publication Data

US 2010/0251885 A1 Oct. 7, 2010

Related U.S. Application Data

(63) Continuation-in-part of application No. 12/199,172, filed on Aug. 27, 2008, now Pat. No. 7,946,214.

(60) Provisional application No. 60/968,733, filed on Aug. 29, 2007, provisional application No. 61/219,007, filed on Jun. 22, 2009.

(51) Int. Cl.
*F41A 5/18* (2006.01)

(52) U.S. Cl. ..... 89/193

(58) Field of Classification Search ..... 89/193, 89/191.02, 191.01, 192
See application file for complete search history.

(56) References Cited

U.S. PATENT DOCUMENTS 1,387,889 A * 8/1921 Johnston ..... 89/193
1,996,124 A 4/1935 Rowley
2,093,706 A 9/1937 Browning
2,186,582 A 1/1940 Gebauer
2,197,942 A * 4/1940 Over ..... 92/160
2,456,290 A 12/1948 Ljutic
2,554,618 A 5/1951 Dixon
2,582,989 A 1/1952 Harvey
2,637,247 A 5/1953 Hester
2,777,366 A 1/1957 Cook (Continued)

FOREIGN PATENT DOCUMENTS

DE 41 36 665 A1 5/1993

(Continued)

OTHER PUBLICATIONS

International Search Report for related Application No. PCT/US2007/012364, mailed Oct. 27, 2008.

(Continued)

*Primary Examiner* — Bret Hayes
*Assistant Examiner* — Reginald Tillman, Jr.
(74) *Attorney, Agent, or Firm* — Womble Carlyle Sandridge & Rice, LLP

(57) ABSTRACT

A piston assembly is provided for a gas-operated firearm of the type having a chamber and a barrel. The piston assembly includes a gas expansion housing and a piston mounted within the gas expansion housing. An annular recess is formed in the outer wall of the piston to receive exhaust gases diverted from the barrel upon firing of the firearm. At least one longitudinally extending groove extends from the annual recess to the head of the piston and forms a pathway for diverting the exhaust gases to the head of the piston. During firing, pressurized gases are diverted into the annular recess and expand longitudinally from the annular recess to the piston head, whereupon the pressurized exhaust gas drives the gas piston rearwardly along the housing.

29 Claims, 14 Drawing Sheets

U.S. PATENT DOCUMENTS

| | | | | | |
|---|---|---|---|---|---|
| 2,887,013 | A | | 5/1959 | Marsh | |
| 2,918,847 | A | | 12/1959 | Barr | |
| 2,918,848 | A | | 12/1959 | Maillard | |
| 2,983,196 | A | | 5/1961 | Dixon | |
| 2,987,968 | A | * | 6/1961 | Janson | 89/193 |
| 3,106,138 | A | * | 10/1963 | Thoma | 92/156 |
| 3,125,930 | A | | 3/1964 | Gilbert | |
| 3,166,983 | A | | 1/1965 | Lizza | |
| 3,207,036 | A | | 9/1965 | Norton | |
| 3,306,168 | A | | 2/1967 | Blumrick | |
| 3,443,477 | A | | 5/1969 | Kaempf | |
| 3,444,641 | A | | 5/1969 | Ruger | |
| 3,568,564 | A | | 3/1971 | Baldi | |
| 3,592,101 | A | * | 7/1971 | Vartanian et al. | 89/193 |
| 3,601,002 | A | | 8/1971 | Janson | |
| 3,601,009 | A | * | 8/1971 | Burgess | 91/234 |
| 3,680,434 | A | * | 8/1972 | Muhlemann | 89/193 |
| 3,690,219 | A | * | 9/1972 | Muhlemann et al. | 89/193 |
| 3,707,110 | A | | 12/1972 | Alday | |
| 3,709,092 | A | | 1/1973 | Tazome | |
| 3,721,163 | A | * | 3/1973 | Hill et al. | 92/158 |
| 3,776,096 | A | | 12/1973 | Donovan | |
| 3,810,412 | A | | 5/1974 | Zamacola | |
| 3,945,296 | A | | 3/1976 | Hyytinen | |
| 3,988,964 | A | | 11/1976 | Moore | |
| 3,990,348 | A | | 11/1976 | Vesamaa | |
| 3,999,534 | A | | 12/1976 | Chapin et al. | |
| 4,014,247 | A | | 3/1977 | Tollinger | |
| 4,015,512 | A | | 4/1977 | Feerick | |
| 4,058,922 | A | | 11/1977 | Elbe et al. | |
| 4,085,654 | A | | 4/1978 | Panigoni | |
| 4,102,242 | A | | 7/1978 | Liedke | |
| 4,109,558 | A | | 8/1978 | Panigoni | |
| 4,125,054 | A | | 11/1978 | Jennie | |
| 4,126,077 | A | | 11/1978 | Quesnel | |
| 4,373,423 | A | | 2/1983 | Moore | |
| 4,389,920 | A | | 6/1983 | Dufour, Sr. | |
| 4,395,838 | A | | 8/1983 | Civolani | |
| 4,409,883 | A | | 10/1983 | Nyst | |
| 4,414,880 | A | | 11/1983 | Throner et al. | |
| 4,475,438 | A | | 10/1984 | Sullivan | |
| 4,505,183 | A | | 3/1985 | Grehl | |
| 4,538,502 | A | | 9/1985 | Benelli | |
| 4,563,937 | A | | 1/1986 | White | |
| 4,599,934 | A | | 7/1986 | Palmer | |
| 4,604,942 | A | | 8/1986 | Benelli | |
| 4,702,146 | A | | 10/1987 | Ikeda et al. | |
| 4,709,617 | A | | 12/1987 | Anderson | |
| 4,765,224 | A | | 8/1988 | Morris | |
| 4,872,392 | A | | 10/1989 | Powers et al. | |
| 4,901,623 | A | | 2/1990 | Lee | |
| 5,173,564 | A | | 12/1992 | Hammond, Jr. | |
| 5,218,163 | A | | 6/1993 | Dabrowski | |
| 5,272,956 | A | | 12/1993 | Hudson | |
| 5,274,939 | A | | 1/1994 | Scaramucci et al. | |
| 5,279,202 | A | | 1/1994 | Bellardi et al. | |
| 5,287,642 | A | | 2/1994 | Scaramucci | |
| 5,351,598 | A | | 10/1994 | Schuetz | |
| 5,404,790 | A | | 4/1995 | Averbukh | |
| 5,448,940 | A | | 9/1995 | Schuetz et al. | |
| 5,499,569 | A | | 3/1996 | Schuetz | |
| 5,520,019 | A | | 5/1996 | Schuetz | |
| 5,726,377 | A | | 3/1998 | Harris et al. | |
| 5,737,865 | A | | 4/1998 | Brandl et al. | |
| 5,767,434 | A | | 6/1998 | Hirtl et al. | |
| 5,824,943 | A | | 10/1998 | Guhring et al. | |
| 5,827,992 | A | | 10/1998 | Harris et al. | |
| 5,872,323 | A | | 2/1999 | Norton et al. | |
| 5,937,558 | A | | 8/1999 | Gerard | |
| 5,939,659 | A | | 8/1999 | Dobbins | |
| 5,959,234 | A | | 9/1999 | Scaramucci | |
| 5,983,549 | A | | 11/1999 | Battaglia | |
| 6,029,645 | A | | 2/2000 | Wonisch et al. | |
| 6,243,978 | B1 | | 6/2001 | Vignaroli et al. | |
| 6,374,528 | B1 | | 4/2002 | Davis et al. | |
| 6,374,720 | B1 | | 4/2002 | Tedde | |
| 6,382,073 | B1 | | 5/2002 | Beretta | |
| 6,508,160 | B2 | | 1/2003 | Beretta | |
| 6,619,592 | B2 | | 9/2003 | Vignaroli et al. | |
| 6,662,485 | B2 | | 12/2003 | Kay | |
| 6,834,455 | B2 | | 12/2004 | Burigana | |
| 6,886,286 | B2 | | 5/2005 | Dowding | |
| 6,889,461 | B2 | | 5/2005 | Vignaroli et al. | |
| 6,971,202 | B2 | | 12/2005 | Bender | |
| 7,162,822 | B1 | | 1/2007 | Heayn et al. | |
| 7,162,823 | B2 | | 1/2007 | Schoppmann et al. | |
| 7,252,138 | B2 | | 8/2007 | Burkhalter et al. | |
| 7,311,032 | B2 | | 12/2007 | Murello | |
| 7,343,844 | B2 | | 3/2008 | Poff, Jr. | |
| 7,448,307 | B1 | | 11/2008 | Dafinov | |
| 7,461,581 | B2 | | 12/2008 | Leitner-Wise | |
| 7,467,581 | B2 | | 12/2008 | Botty | |
| 7,946,214 | B2 | * | 5/2011 | Stone | 89/193 |
| 2001/0054350 | A1 | | 12/2001 | Beretta | |
| 2002/0073832 | A1 | | 6/2002 | Vignaroli et al. | |
| 2002/0096042 | A1 | | 7/2002 | Adkins | |
| 2002/0139362 | A1 | | 10/2002 | Shipachev et al. | |
| 2005/0016374 | A1 | | 1/2005 | Pescini | |
| 2005/0223613 | A1 | | 10/2005 | Bender | |
| 2005/0235817 | A1 | | 10/2005 | Murello | |
| 2005/0257681 | A1 | | 11/2005 | Keeney et al. | |
| 2005/0268516 | A1 | | 12/2005 | Nelson | |
| 2006/0065112 | A1 | | 3/2006 | Kuczynko et al. | |
| 2007/0012169 | A1 | | 1/2007 | Gussaili | |

FOREIGN PATENT DOCUMENTS

| | | | |
|---|---|---|---|
| EP | 1 215 464 | | 6/2002 |
| EP | 1 624 275 | | 2/2006 |
| FR | 2 686 152 | | 7/1993 |
| GB | 214505 | A | 4/1924 |
| GB | 1405189 | | 9/1975 |
| RU | 2279028 | C1 | 6/2006 |
| WO | WO-2009/061546 | | 5/2009 |
| WO | WO-2008/108786 | | 9/2009 |
| WO | WO-2010/151549 | A1 | 12/2010 |

OTHER PUBLICATIONS

Written Opinion for related Application No. PCT/US2007/012364, mailed Oct. 27, 2008.

International Search Report for related Application No. PCT/US2008/074601, mailed Jul. 21, 2009.

Written Opinion for related Application No. PCT/US2008/074601, mailed Jul. 21, 2009.

International Search Report for related PCT application No. PCT/US2010/039526, mailed Sep. 3, 2010.

Written Opinion for related PCT application No. PCT/US2010/039526, mailed Sep. 3, 2010.

* cited by examiner

GAS SYSTEM FOR FIREARMS

CROSS REFERENCE TO RELATED APPLICATIONS

This application is a Continuation-in-Part of U.S. patent application Ser. No. 12/199,172, filed Aug. 27, 2008, and which claims the benefit of U.S. Provisional Application No. 60/968,733, entitled GAS SYSTEM FOR FIREARMS, filed Aug. 29, 2007, and further claims the benefit of U.S. Provisional Application No. 61/219,007, filed Jun. 22, 2009, entitled "FIREARM OPERATING SYSTEM", all of the above-referenced applications being incorporated herein by reference as if set forth in their entirety.

FIELD OF THE INVENTION

The present invention generally relates to an assembly for directing expanding propellant gases from the chamber of a firearm to an expansion chamber housing a piston for semi-automatic and/or fully automatic firearms.

BACKGROUND OF THE INVENTION

Semi-automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

In semi-automatic and fully automatic firearms, including rifles and shotguns, a portion of the expanding gases typically are directed through a duct or port that interconnects the barrel of the firearm to a piston assembly that generally houses an axially moveable piston. The portion of the explosive gases that are diverted from the barrel of the firearm act upon the piston so as to force the piston rearwardly to thus cause the rearward motion, or recoil of the bolt of the firearm. This rearward motion opens the chamber and ejects the empty shell or cartridge casing, and thereafter loads another shell or cartridge into the chamber, after which the bolt returns to a locked position for firing as the gases dissipate or are bled off.

Known gas actuating piston assemblies for semi-automatic firearms can suffer from numerous disadvantages, however, including the inability to regulate the gas energy being transmitted to the piston. Also, when lower power cartridges or shells are used, the pressure of the discharge gases sometimes is not sufficient to properly or fully actuate/drive the piston assembly, which can result in misfired or jammed shells or cartridges.

It therefore can be seen that a need exists for a firearm that addresses the foregoing and other related and unrelated problems in the art.

SUMMARY OF THE INVENTION

One embodiment of the present invention is directed to a gas system including a gas redirecting piston assembly for a gas-operated firearm. Such a firearm typically will have a barrel, a chamber, a firing assembly or fire control including a trigger, and a bolt that is translatable between a loading position and a firing position behind a cartridge/shell to be fired.

In one embodiment, the gas system including a gas redirecting piston assembly comprises a tubular gas expansion housing and a piston. The piston is slideably mounted within the tubular expansion housing and includes a first, open tubular end and a second, closed end or piston head. The open tubular end defines an inner bore that is dimensioned to receive a connecting rod, or can be profiled so as to mate with a connecting rod externally held by a gas block.

An annular recess is formed in the outer surface of the piston proximate the open tubular end. In one embodiment, the piston further includes an annular gas seal formed or applied at its open tubular end, with the annular recess generally being formed between the annular gas seal and the closed piston head. Multiple similarly formed and radially-spaced longitudinal groves can extend along the body of the piston from the annular recess to the piston head to provide pathways for directing the combustion gases necessary for driving the piston along the expansion housing. The grooves can be formed in a variety of configurations extending along the body of the position and can be of varying widths and depths for receiving a desired volume of combustion gases therealong. For example, the grooves can be substantially straight or can be angled or curved. The arrangement of the grooves further can be designed to provide a spin or rotation of the piston body during a firing operation to help in cleaning of the expansion housing by the movement of the piston along the inner bore of the expansion housing. The grooves can also be eliminated and the allowable gap between the gas block and the piston held to a desired tolerance as needed to further limit the escape of gases and improve system efficiency and sealing. Mechanical seals also can be added about the piston, in addition to or without the grooves being formed in the body of the piston to further increase the efficiency of the system.

A mechanical stop can be extended through the wall of the expansion housing for cooperatively engaging an elongated axial slot in the piston to thus limit the axial travel of the gas piston in the tubular housing. Alternatively, this stop feature can be eliminated and/or supplemented by allowing the motion of the piston to stop on the operating rod housed within the piston. Still further, the motion of the system also can be controlled by control of the action spring to allow its movement to slow, then stop the piston movement post purging of gas from the system. In other embodiments, the gas piston can be formed with a gas "shut-off" feature to limit the amount of gas diverted from the barrel through the gas ports to the piston. In another embodiment, the piston also can include a gas purge feature that evacuates the gas upon completion of a full stroke of the piston, thus reducing or eliminating the damping effect on the return stroke of the piston.

In operation, when the firearm is fired, pressurized exhaust gases in the chamber region are diverted through a duct or path located between the barrel and the tubular housing into the annular recess. The pressurized gas expands and travels along the spaced grooves of the piston body to the operating head of the gas piston, and forces the piston to move axially rearwardly along the housing. This axial movement compresses the spring and drives the connecting rod rearwardly to translate the breech bolt or bolt rearwardly and open the chamber for reloading. As the gas pressure dissipates and is evacuated, the force of the spring drives the connecting rod and piston forwardly into a pre-firing position, thus completing a firing cycle.

These and other features and aspects of the invention will become more apparent upon review of the detailed description set forth below when taken in conjunction with the accompanying drawing figures, which are briefly described as follows.

BRIEF DESCRIPTION OF THE DRAWINGS

The invention is better understood by reading the following detailed description of the invention in conjunction with the accompanying drawings.

DESCRIPTION OF THE INVENTION

Figure 1:
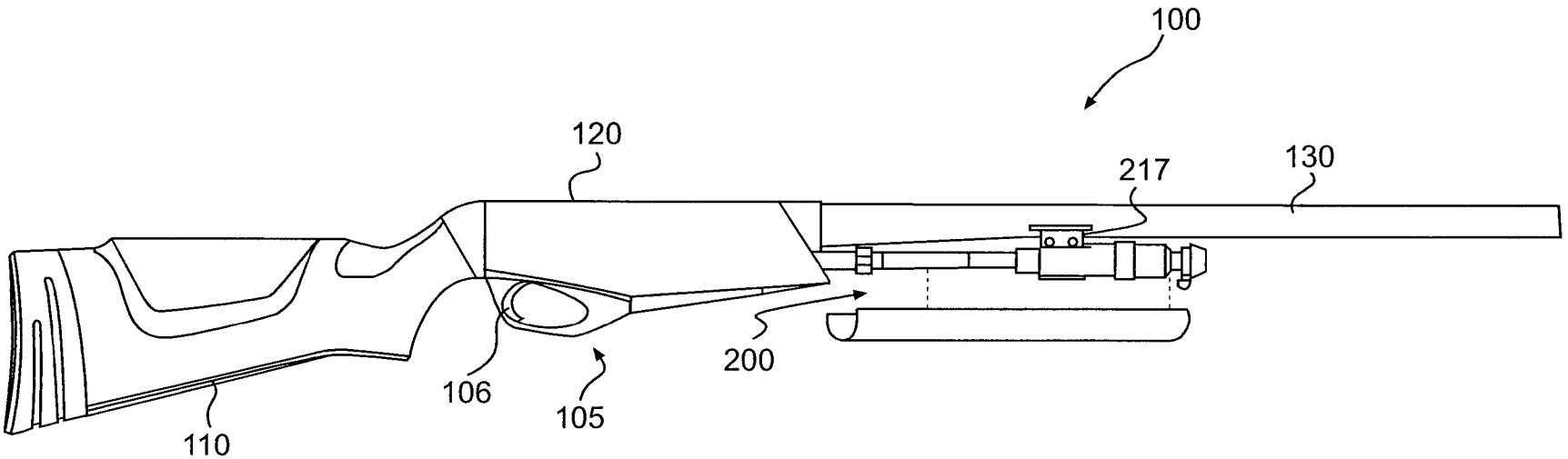
FIG. 1 illustrates a firearm with one exemplary embodiment of the gas redirecting piston assembly according to the principles of the present invention.
Figure 2:
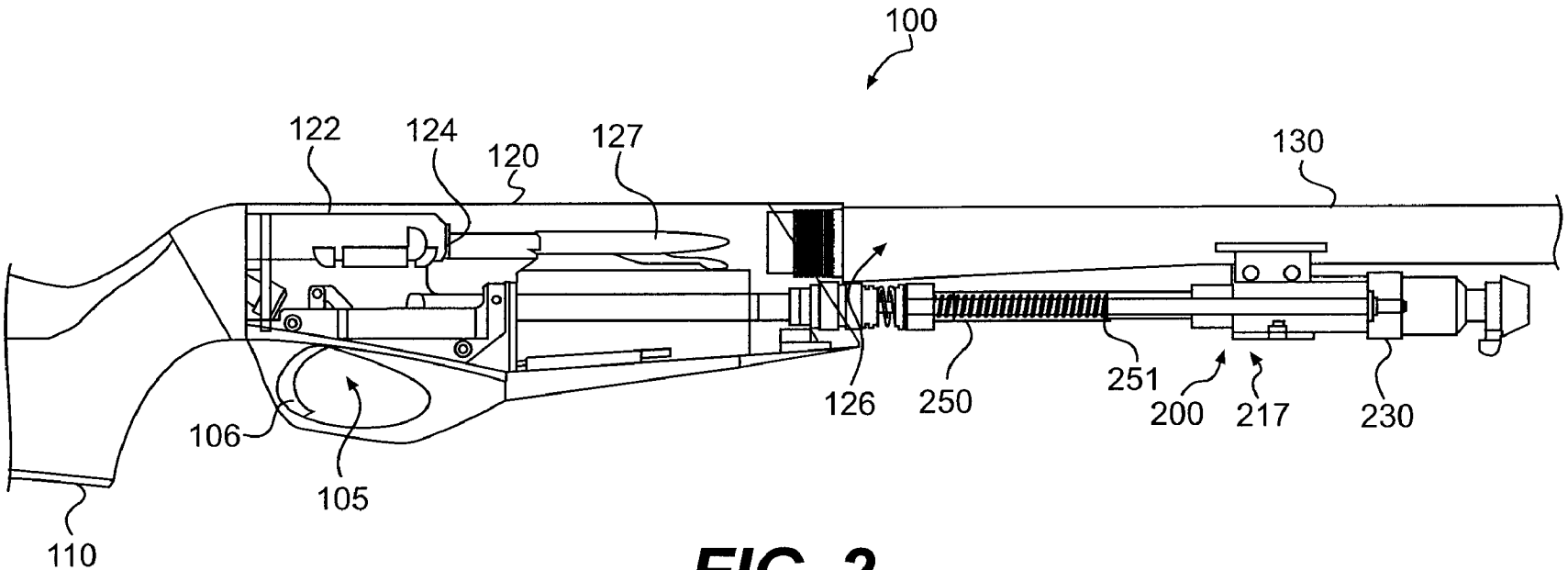
FIG. 2 is a cutaway view of the firing mechanism, chamber, barrel, and the gas redirecting piston assembly of the firearm of FIG. 1.

Referring now to the drawings in which like numerals indicated like parts throughout the several views, FIGS. 1 and 2 illustrate one example embodiment of the gas system including gas redirecting piston assembly according to the principles of the present invention for use in a firearm such as a semi-automatic or fully automatic rifle, although it will be understood that the gas redirecting piston assembly can be used in various types of firearms including shotguns. Military style firearms such as an M4 or AR type rifle, and other long guns, hand guns and other semi-automatic and/or fully automatic gas operated firearms. Those skilled in the relevant art further will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

As shown in FIGS. 1 and 2, a firearm incorporating the gas system, here shown as a rifle or shotgun 100, generally is illustrated. The firearm 100 generally comprises a fire control 105 including a trigger 106, a stock 110, a receiver 120, and a barrel 130. The stock 110, also known as the buttstock or shoulder stock, may be formed in any conventional manner to include cushioning, special curvatures, grips, etc. As shown in FIG. 2, the receiver 120 typically houses and includes the firing mechanism or fire control 105, a breech bolt or bolt assembly 122, and a firing pin 124. The bolt assembly 122 is axially translatable forwardly and rearwardly along the receiver during the firing cycle and generally is located behind a chamber portion 126 located at the proximal end of the barrel 130 adjacent the receiver. The chamber 126 receives a shell or cartridge 127 for firing as the bolt assembly is cycled and extends into the barrel 130 in open communication therewith.

In the gas-operated firearm 100 illustrated in FIGS. 1 and 2, a gas-operated redirecting piston assembly 200 is provided for reloading the chamber after firing by way of mechanical interconnection and interaction between the gas redirecting piston assembly and the bolt 122. During a firing operation, the action of the gas piston, which in turn is translated to the bolt, functions to automatically clear or discharge a spent cartridge/shell casing from the chamber, load a new cartridge/shell into the chamber, and recock the firing pin and bolt for a next firing cycle.

Figure 3:
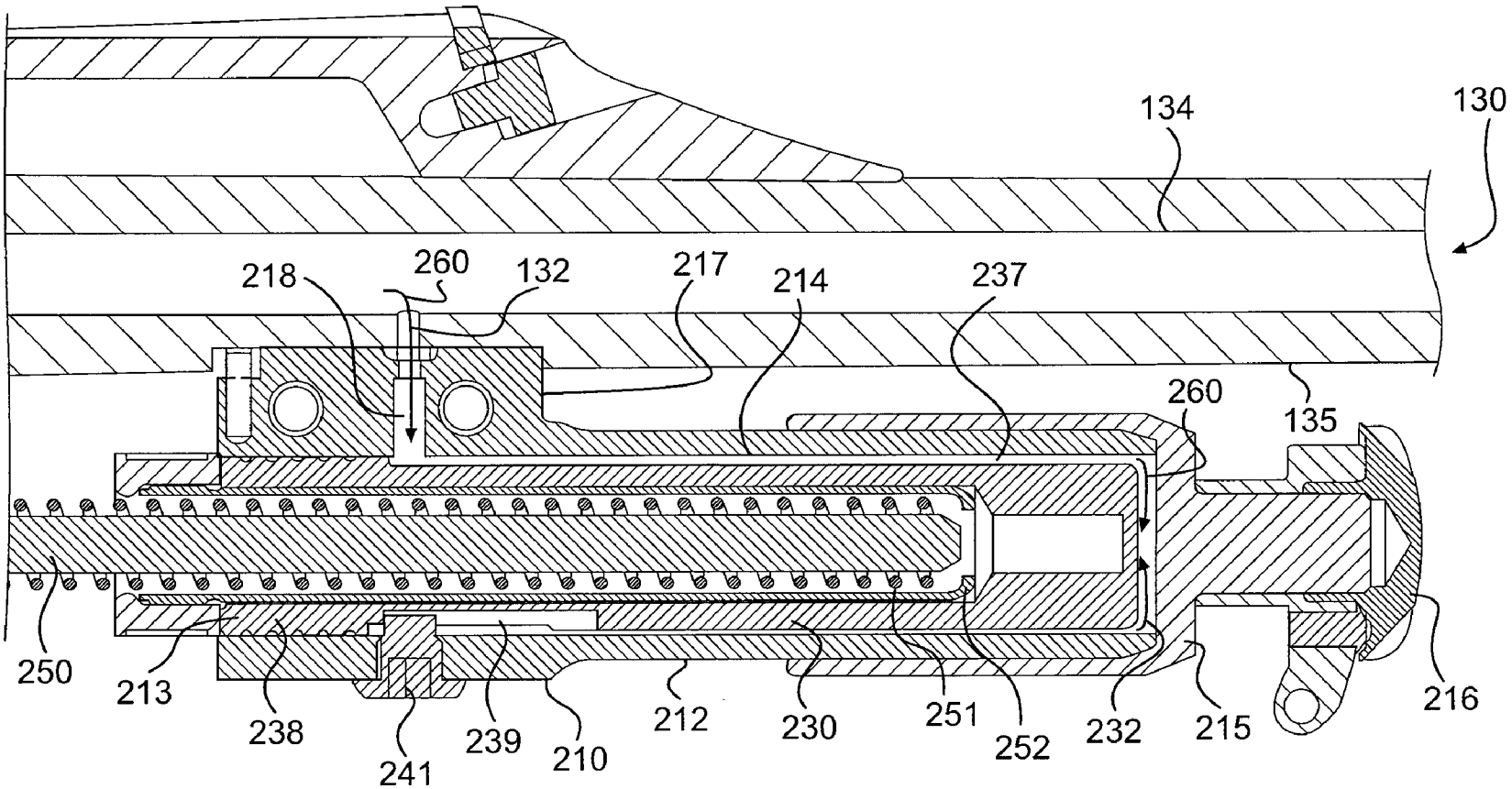
FIG. 3 is a cross-sectional view of one embodiment of the gas redirecting piston assembly of the present invention, illustrating the relative position of the piston before firing.
Figure 4:
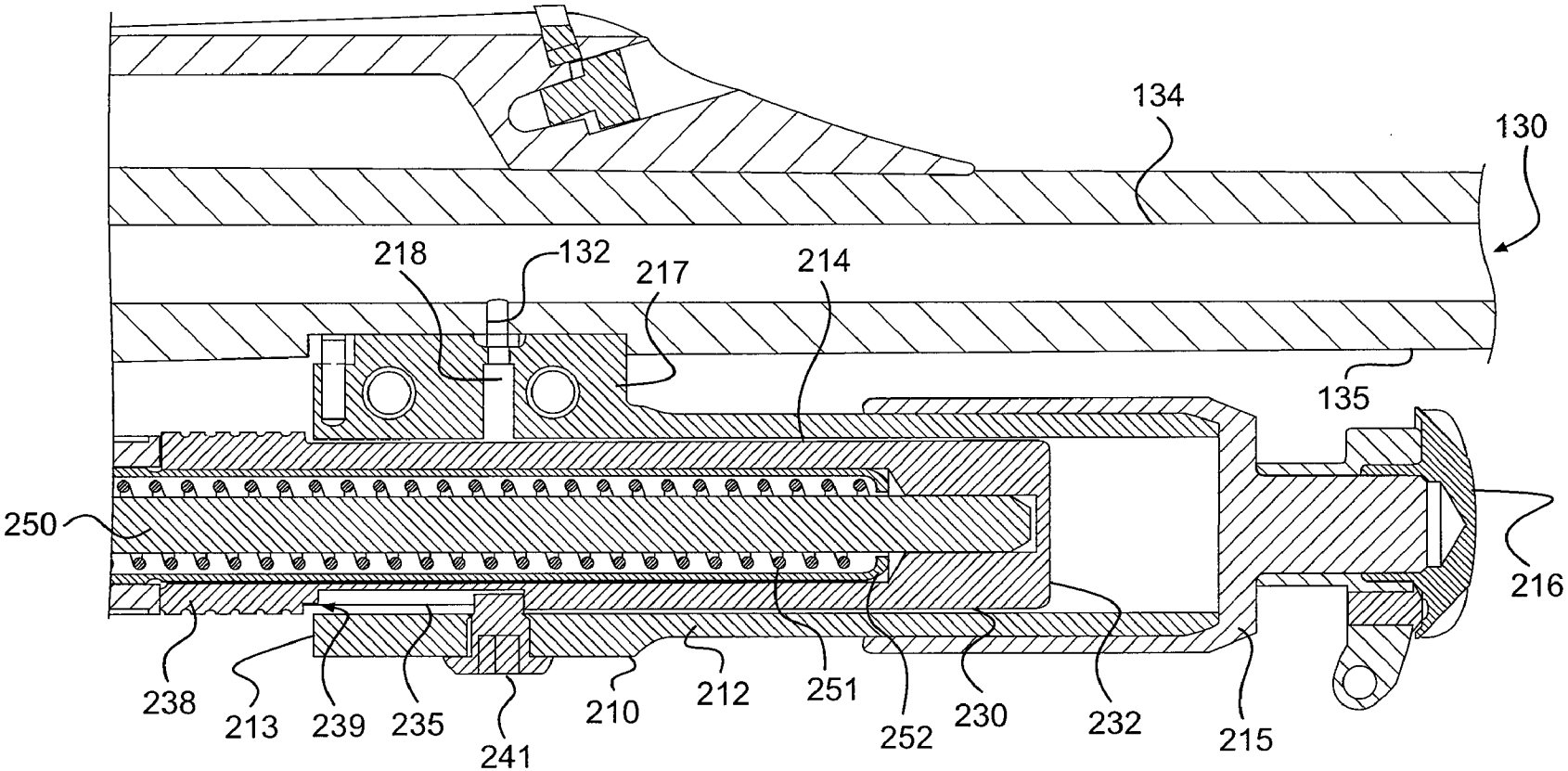
FIG. 4 is a cross-sectional view of one embodiment of the gas redirecting piston assembly of the present invention illustrating the relative position of the piston after firing.

As shown in FIGS. 3 and 4, in one example embodiment, the gas-redirecting piston assembly 200 according to the principles of the present invention comprises an elongated tubular gas expansion housing 210 with a gas piston 230 slideably mounted within the gas expansion housing 210. The tubular gas expansion housing 210 generally is formed as a substantially hollow cylinder having an outer cylindrical wall 212 and defines an inner bore 214 extending therealong. It will be understood that the expansion housing 210 and/or its inner bore or chamber 214 also can have other shapes or geometries such as rectangular, triangular, etc. The first or rear end 213 of the housing 210 is open to receive the gas piston 230, while its second or forward end 215 can be enclosed by a sealing cap 216 or may be formed as a closed end defining a concave orifice at the end of the housing. As further indicated in FIGS. 1-4, mounting lug 217 generally supports the housing 210 and interconnects the housing 210 to the underside of the barrel 130 of the rifle. The mounting lug 217 may be either integrally formed with the gas expansion housing 210 or may be a separately formed component.

A gas port 218 extends through the mounting lug 217 into the gas expansion housing 210 to enable passage of exhaust gases generated during a firing operation, as indicated by arrow 260 in FIG. 3. The gas port 218 is located along the barrel adjacent and/or slightly downstream from the chamber so that when the mounting lug 217 and housing 210 are installed beneath the barrel 130, the gas port is aligned with and is located in fluid communication with a gas duct 132 that extends between the inner bore 134 of the barrel 130 and the outer side wall 135 of the barrel 130. The relative diameters of both the gas port 218 and the gas duct 132 generally can be selected based upon firearm type and/or the types of ammunition to be used. The gas duct 132 and/or gas port 218 additionally can be located at varying positions along the barrel, typically ranging from about 2 inches to about 10 inches down-barrel from the chamber, although greater or lesser spacings/distances also can be used.

As further indicated in FIG. 3, the barrel of the firearm can utilize a shoulder or other means to locate the gas expansion housing of the gas system along the frame/chassis and/or the barrel of the firearm such that the orifice or gas duct 132 of the barrel is concentric with the orifice or gas port 218 formed in the gas expansion housing. The gas port 218 of the gas block may or may not be user changeable, such as through either a selector mechanism that enables different sized orifices or gas ports to be selectively presented to the duct 132, or by use of replaceable inserts that allow different size orifices or gas ports 218 to be installed in the gas expansion housing by the operator. The gas duct and port in the barrel and gas expansion housing generally allow a fixed or desired flow rate of propellant gases generated during firing the round of ammunition to be diverted from the barrel through the gas expansion housing and into a diversion chamber created by a reduced diameter section in the gas piston and the wall of the inner bore 214 of the gas expansion housing.

As described in greater detail below, one or more additional apertures may be formed through the cylindrical wall of the housing for the insertion of mechanical bosses, or stops. FIG. 3 illustrates the relative position of the gas piston 230 within the housing 210 in one embodiment in a first position in preparation for firing, wherein the piston 230 is in a resting or retracted position within the housing 210, whereas FIG. 4 illustrates the relative position of the gas piston 230 within the housing 210 immediately after firing, with the piston 230 being shown in its engaged, operative position, having moved longitudinally toward a second position adjacent the rear end of the housing 210.

Figure 5:
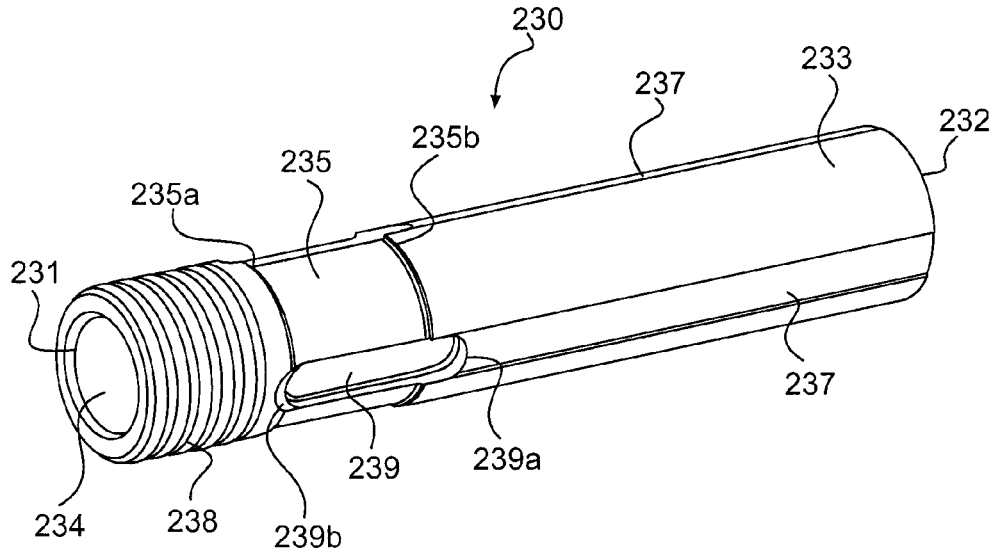
FIG. 5 is a rear perspective view of an embodiment of the piston.
Figure 6:
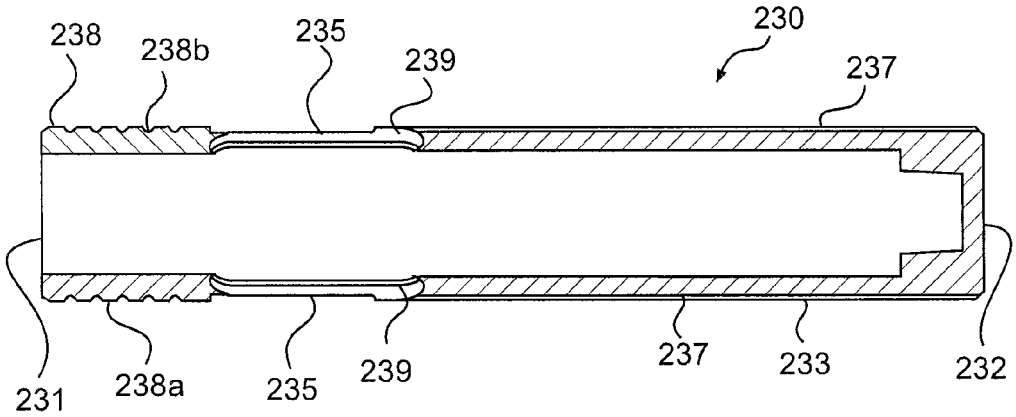
FIG. 6 is a side cross-sectional view of the piston of FIG. 5.

Turning to FIGS. 5 and 6 for a more detailed view of the gas piston, the gas piston 230 also generally comprises a cylindrical body having an open tubular first end 231, a closed head or second end 232, and a substantially smooth outer surface 233. As will be appreciated by those skilled in the art, the outside diameter of the piston 230 approximates the diameter of the inner bore 214 of the gas expansion housing 210, taking into consideration such factors as mechanical tolerances, anticipated operating conditions, friction, mechanical efficiency, etc. An inner bore or chamber 234 is defined within the piston body and extends longitudinally therealong from the open tubular end 231 to the head 232. The inner bore 234 is dimensioned to receive a spring-loaded connecting rod 250 and a piston spring 251 therein, as illustrated in FIGS. 2-4. During operation, an actuator block 252 is provided within the inner bore 234 to engage the piston spring 251.

As shown in FIGS. 5 and 6, an annular recess 235 is formed in the outer surface 233 of the gas piston 230. This annular recess 235 generally extends around substantially the entire circumference of the outer surface 233 of the piston 230 in the embodiments shown, and extends axially (longitudinally) a selected distance defined by front or upstream and rear or downstream edges 235*a*, 235*b*. The annular recess is dimensioned with a reduced diameter or depth/width in the piston body, and is located intermediate the first open end 31 and the head 232 of the gas piston, and acts as an initial receptor for the redirected exhaust gases that are diverted from the barrel 130 proximate the chamber 122 of the rifle 100 through the gas port 218 during firing. The annular recess 235 thus helps facilitate the distribution of the expanding exhaust gases around the entire circumference of the gas piston 230.

Figure 7:
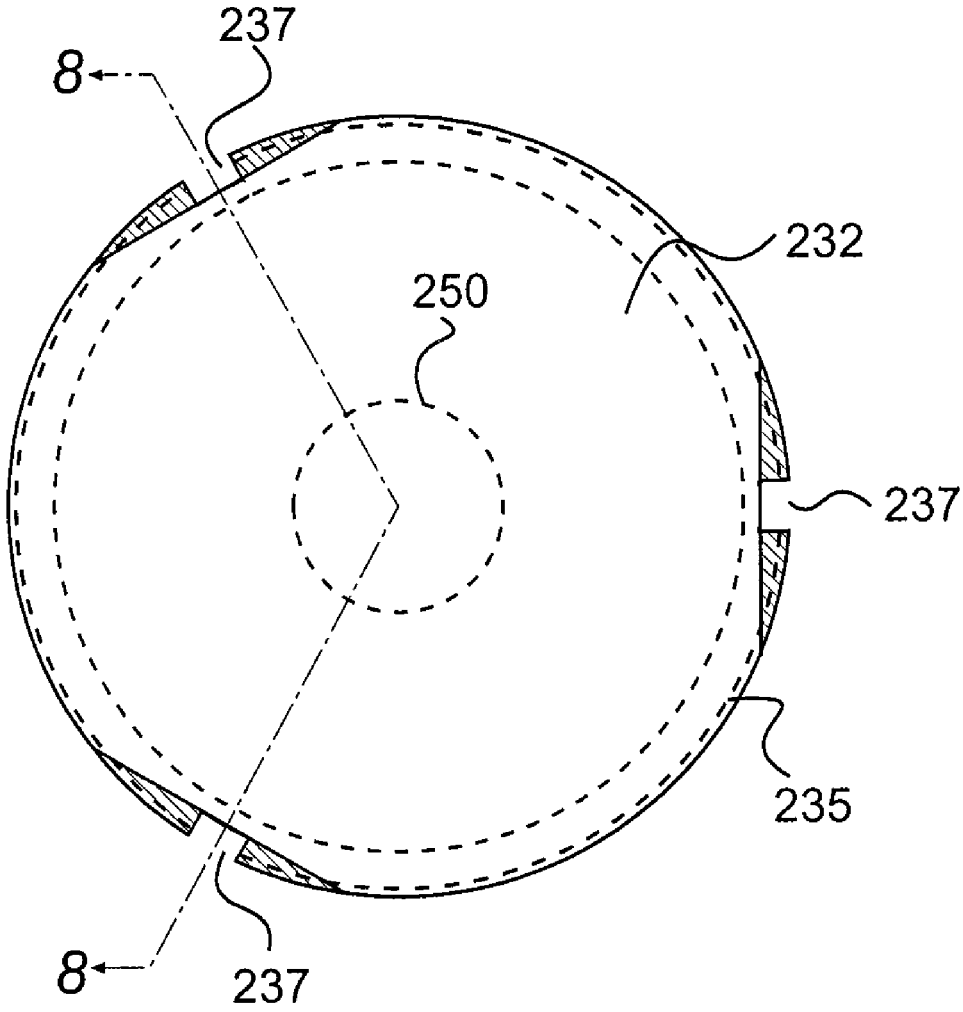
FIG. 7 is an end view of the piston of FIG. 5.

As shown in FIG. 5, at least one longitudinally extending groove or slit 237 typically is formed in the outer surface of the piston and extends approximately from the front edge 235*b* of the annular recess 235 to the forward, second end, or head 232 of the piston 230. The groove 237 generally creates a pathway for the exhaust gas from the annular recess 235 to the head 232 of the gas piston 230. In the embodiment shown in FIGS. 5 through 7, three generally longitudinally extending gas flow directing grooves 237 are formed in the outer cylindrical surface 233, although fewer or more grooves (and grooves of different sizes/configurations, such as spiral or helical, slotted, tapered, etc.), can be provided as needed or desired. For example, it may be desirable to provide multiple, equally-spaced apart grooves to provide enhanced channeling of a sufficient volume of expanding gas to the closed head 232 of the gas piston for proper actuation; and/or to help maintain symmetry and center of gravity for the piston 230 during the firing cycle. As will be also appreciated, the number and relative dimensions (width and depth) of the gas flow directing grooves 237 is not critical to the piston 230 of the present invention as long as the desired operational characteristics of the gas piston assembly 200 are achieved.

In addition, an annular turbulent gas seal 238 generally can be formed about the circumference of the piston proximate the open tubular end 231 thereof. The annular gas seal 238 is shown in the illustrated embodiment as comprising a series of spaced, parallel ridges 238*a* and grooves 238*b* to create a mechanically efficient piston seal in a manner understood in the fluid arts. It will also be understood that additional, alternative sealing materials such as steel or other metallic sealing materials, as well as other types of seals, also can be used, as will be understood by those skilled in the art.

As shown in FIGS. 5 and 6, at least one elongate axial slot 239 also is formed in the outer surface 233 of the gas piston 230. As will be described in greater detail below, the elongate axial slot 239 may extend from a point 239*a* located forwardly of the front edge 235*a* of the shallow annular recess 235 to a point 239*b* located rearwardly of the rear edge 235*b* of the annular recess 235. In one embodiment, the elongate slot 239 is approximately co-linear with at least one longitudinally extending gas flow directing groove 237 and extends to a depth greater than the depth of both the annular recess 235 and the longitudinally extending gas flow directing groove 237. In the particular embodiment shown in FIGS. 5 and 6, the piston 230 includes three elongate axial slots 239, corresponding to the number of longitudinally extending gas flow directing grooves 237, although fewer or more slots can be provided as needed. The locating of the rear edge or point 239*b* of each of the slots 239 rearwardly of the rear edge 235*b* of the recess 235, in conjunction with the rear end 213 of the housing 210, helps provide an opening or purge area for the excess exhaust gases when the piston 230 is at its full stroke as shown in FIG. 8B. Additionally, a stop, or boss, 241 extends through the wall 212 of the housing 210 to cooperatively engage one of the elongate axial slots 239 and thus helps control or limit the rearward and forward travel of the piston 230 during actuation.

The installation and operation of the gas-operated piston assembly 200 according to the principles of the present invention is best illustrated by reference to the cross sectional views of FIGS. 3 and 4, and the schematic illustrations of FIGS. 8A and 8B. In the initial firing position, the piston 230 is seated in its forwardly extended first or rear position along the gas expansion housing 210 in preparation for firing. The spring 251 maintains a compressive pressure on the piston 230 through the inner bore of the piston by way of the actuator block 252. Upon firing, the explosive force of the propellant in the chamber 122 of the firearm 100 creates exhaust gases which rapidly expand and travel outwardly from the chamber, into the barrel region, ultimately discharging through the muzzle.

In some prior art devices, the gas port for directing the exhaust gases from firing, typically is located substantially downstream along the barrel to divert some portion of the expanding gases substantially directly against the head of a gas piston or piston chamber. It has been found by the inventor, however, higher bore pressure or force from such exhaust gases may be directed to the piston when the expanding exhaust gases are captured and diverted to the piston as closely as possible to the chamber region of the rifle. In the chamber region, the gases from the exploding propellant are still expanding at rapid rate, whereas the further downstream in the barrel the gases are diverted, less bore pressure is a variable as the expansion rate diminishes significantly along the barrel length. Further, positioning the gas port as closely as possible to the chamber helps ensure a longer impulse (in terms of time), delivered by the expanding gases, for driving the piston 230.

More particularly, it has been found that the "burn" of the propellant from a cartridge occurs in phases. The closer the gas port 132 is to the chamber, the more likely that incompletely burned residue will be deposited on the piston 230 and within the housing 210. This results from the progressive nature of the burning of the powder as in an initial phase, when combustion/explosion is still occurring. Thus, the inventors have discovered that gas port 132 locations for the embodiments described herein are optimal at a point where a balance may be achieved between a sufficient bore pressure available to the piston and a satisfactory level of burn of the propellant. It has therefore been found that for the variety of anticipated ammunition types, comprising different types and amounts of propellants, the gas port is desirably located at a position wherein between about seventy percent and about eighty percent of the propellant contained in the cartridge/shell being fired generally will have been burned. For the embodiments described herein, this corresponds to a gas port location of generally between about two inches and about eight inches from the upstream or rear end of the chamber, although it will be understood that further variations in this location can be utilized as needed depending on cartridge/shell length, and other factors.

It has additionally been found that the configuration and location of the gas redirecting piston assembly 200 according to the principles of the present invention enables the higher pressure, rapidly expanding gases from firing to be diverted at a reduced, substantially optimal distance from the chamber and channeled to the piston head. Thus, the exhaust gases may be diverted, or rather, redirected upstream so as to be controllably applied to the head of the piston through the recesses and longitudinal grooves described herein.

Figure 8A:
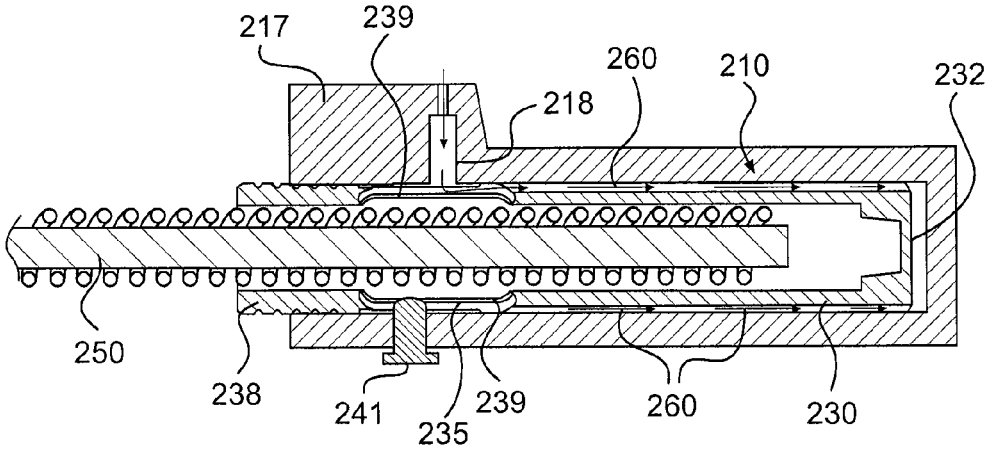
FIGS. 8A and 8B are schematic illustrations showing the action of the gas on the piston during the firing cycle.
Figure 8B:
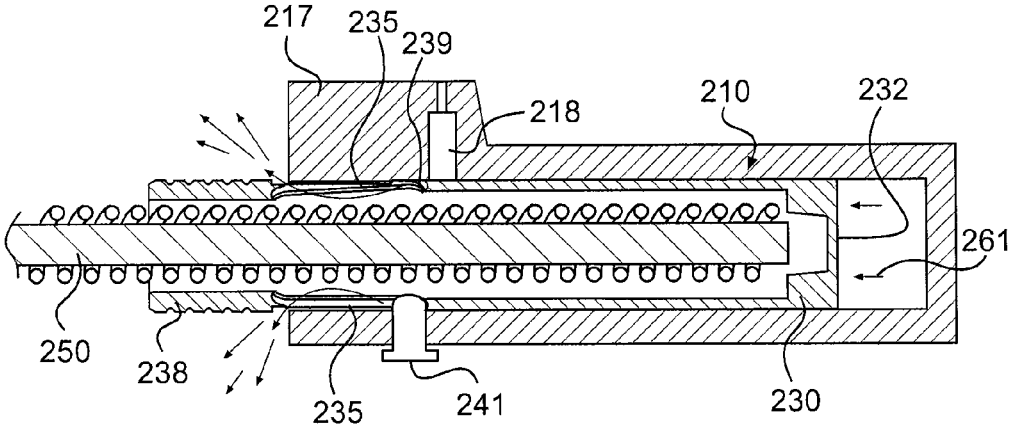

As shown in FIGS. 3 and 8A, at the beginning of the firing cycle, the expanding propellant gases are diverted through the gas duct 132 and through the gas port 218 into the gas expansion housing 210 proximate the annular recess 235. The gas seal 238 seals against the housing as the pressurized gases enter the annular recess 235, and accordingly blocks the passage of the gases along the housing in a rearward direction. As a result, as indicated in FIG. 8A, as the expanding gases fill the annular recess 235, they are forced longitudinally forwardly along the gas directing grooves to the head 232 of the piston 230 in the direction of arrows 260. The force of the expanding gases acting against the head 232 of the piston 230 drives the piston rearwardly from its initial or first position toward its second position, as indicated by arrows 261 in FIG. 8B, causing the actuator block 252 to engage and overcome the force of the spring 251. This then causes the bolt/breech bolt 122 to be translated rearwardly along the receiver 120, wherein the spent cartridge casing is ejected and a new cartridge "chambered."

At this point in the firing cycle, the relative position of the piston 230 is as shown in FIGS. 4 and 8B. The gas seal 238 now projects outwardly from the end of the housing 210 and rearward travel of the piston 230 can be limited by the boss, or stop, 241 abutting the forward edge 239*a* of the elongate axial slot 239. As illustrated schematically in FIG. 8B, the location of the gas port 218, in combination with the location and relative dimensions of the stop 241, annular recess 235, and elongate axial slot 239 enable two additional aspects of this embodiment of the gas piston assembly 200 to function. First, as shown in the Figures, the rearward movement of the piston 230 defines or creates an obstruction that generally limits and/or at some point substantially blocks the flow of expanding gases through the port 218 and into the housing, and therefore into the annual recess 235, by virtue of the outer surface of the piston slidingly blocking or moving in front of the outlet of the port 218. Further, the rear edges 239*b* of the one or more elongate axial slots 239 are formed to extend slightly beyond the open end 213 of the housing 210, thus creating one or more purge vents for the evacuation of the propellant gases from the housing 210 (shown by the arrows). This release of the trapped exhaust gases effectively limits the damping that the piston will experience upon return to its original position within the housing 210. Thus, the piston may smoothly retract to its starting position of FIG. 3, completing one firing cycle.

Figure 9:
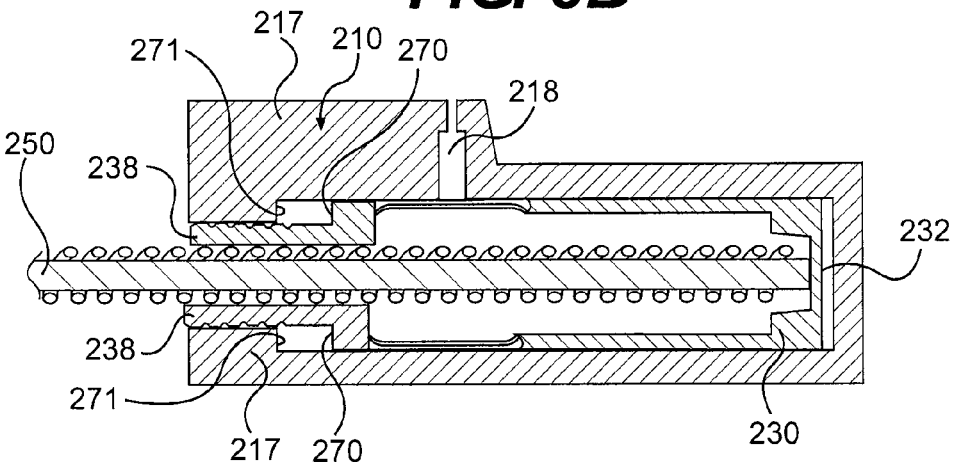
FIG. 9 is a side cross-sectional view of a portion of the gas expansion housing and piston, illustration a stop feature on the piston.

As additionally shown in FIG. 9, the piston 230 further can be configured so as to define a stop portion or edge 270 along the rearward or second end thereof, adjacent the gas seal 238. The gas expansion housing 210 similarly can be configured to provide a bearing surface or stop 271 against which stop or edge 270 of the piston 230 will engage as the piston reaches the desired limit or full extent of its rearward travel in operation. The stop 270 and bearing surface 271 can be defined so as to limit the travel of the piston along the housing to a desired amount and to prevent overtravel of the piston to a point where its return stroke or movement could be impaired.

Figure 10A:
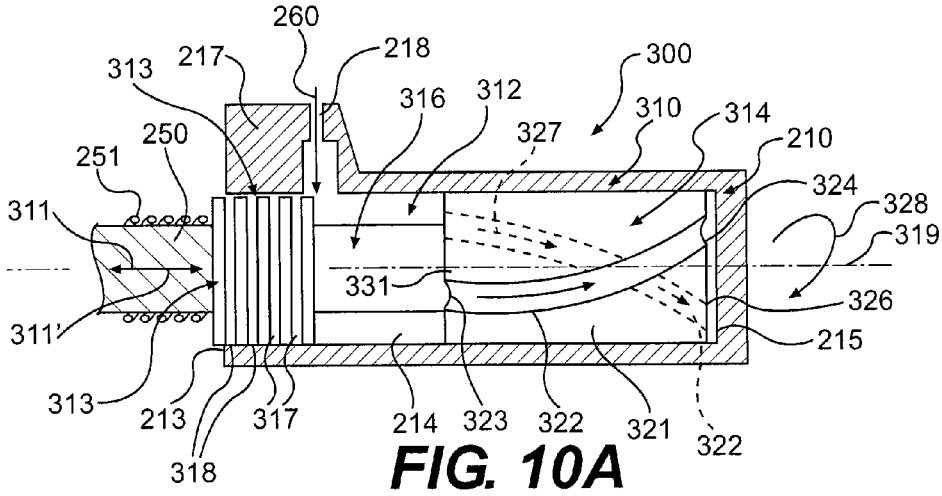
FIGS. 10A-10C are side cross-sectional views illustrating an additional embodiment of the gas redirecting piston of the present invention in operation.
Figure 10B:
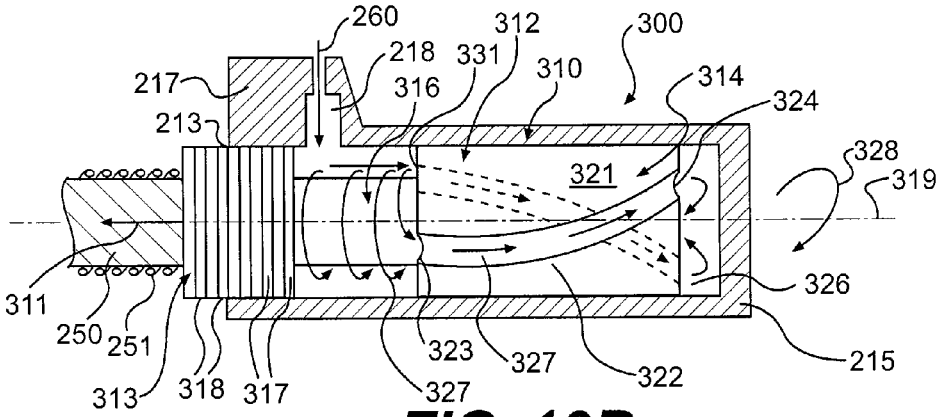

In an additional embodiment of the gas system of the present invention, a gas redirecting piston assembly 300 is provided as shown in FIGS. 10A-10B, in which a gas piston 310 of the present embodiment is shown slideably received and movable along the inner bore 214 of gas expansion housing 210 in the direction of arrows 311 and 311'. As noted above, the gas expansion housing 210 generally is formed as a substantially hollow cylinder or housing, although other shapes or geometries also can be used, defining the chamber or inner bore 214 and having a first or rear end 213, which is open so as to receive the gas piston 310 therethrough, a second or forward end 215 that can be enclosed by a sealing cap or may be integrally formed as closed end, defining a face at the forward end of the housing. The inner bore 214 extends along the housing from the first, open end 213 to the second, closed end 215 and, as indicated in FIGS. 10A and 10B, is in open communication with a gas port 218, which extends through the mounting lug 217 of the firearm and into the gas expansion housing 210 for passage of exhausted combustion gases generated during a firing operation as indicated by arrows 260. As also noted above, the gas port 218 generally is located along the barrel adjacent and/or downstream from the chamber, with the gas port being in fluid communication with a gas duct that extends through the barrel of the firearm for receiving the exhausted combustion gases from the barrel/chamber as a firing operation commences.

In the present embodiment of the gas reciprocating piston assembly 300 shown in FIGS. 10A and 10B, the gas piston 310 includes a body 312, shown as being generally cylindrical or otherwise configured or shaped so as to be received and slideable along the bore 214 of the gas expansion housing 210. The piston body 312 generally is substantially hollow so as to receive one end of the connection rod 250 and the spring 251 positioned thereabout as discussed above. The piston body 312 further includes a first, open ended section or portion 313 adjacent the open end 213 of the housing 210, and a second end or head section or portion 314 adjacent the closed or second end 215 of the gas expansion housing. An intermediate, annular recess section 316 is formed between the first and second end portions 313 and 314, with the annular recessed section having an undercut area or reduced diameter/depth so as to provide a space for an initial gas fill volume of the exhaust combustion gases, indicated by arrows 260, entering into the gas expansion housing via the gas port 218.

As further indicated in FIGS. 10A and 10B, the first end portion 313 of the gas piston 310 generally is formed as a turbulent gas seal and has a diameter (within desired tolerances) approximately equivalent to the diameter of the bore 214 of the gas expansion housing 210 so as to be able to slide therealong without shifting or otherwise being subject to undue movement within the bore. The first end portion 313 further includes a series of grooves or recesses 317 formed at spaced intervals therealong, and can be formed with varying tolerances as needed for sealing the bore as the piston moves therealong.

As a further alternative, if desired, one or more annular gaskets or gas seals 318 can be received within the grooves or recesses 317 of the first end portion 313. The one or more gas seals 318 can include mechanical gas seals formed from various materials, such as stainless steel or other, similar material seals, or could include flexible, compressible synthetic, rubber or plastomeric sealing materials, and/or combinations thereof. Such additional gas seals generally can be applied substantially about the entire circumference of the first end portion of the piston body. The seal(s) further generally will have an expanded diameter or thickness (as indicated in FIG. 10A) so as to engage and seal against the inner wall of the bore 214 of the gas expansion housing 210 as the gas piston moves therealong to guard against gas leakage.

In this embodiment, the second end or head portion 314 of the gas redirecting piston assembly 300, similarly generally is formed with a diameter, height or width that approximates the diameter, height or width of the inner bore of the gas expansion housing (depending upon the shape or configuration thereof), taking into account factors such as mechanical tolerances, anticipated operating conditions, friction, mechanical efficiencies, etc., so as to be slideable along the length of the bore of the gas expansion housing in the direction of arrows 311 and 311' without binding and/or without undue lateral motion that could interfere with the longitudinal sliding movement of the piston body along a longitudinal axis of its geometry, indicated at 319, extending through the gas expansion housing and generally being concentric with a vector defined by the first and second positions of the piston before and after firing. The second end or head portion 314 further includes a substantially cylindrical outer side wall 321, in which a series of gas flow directing grooves 322 are formed.

The gas flow directing grooves 322 extend along the head portion 314 from a first open end 323 adjacent the intermediate annular recess section 316 of the piston body, to a second, open end 324 formed at the distal end or face of the head portion, adjacent the closed second end 215 of the gas expansion housing 210, as indicated in FIG. 10A. The gas flow directing grooves 322 are shown as being formed with a generally angled, curved or helical configuration or orientation, rather than extending substantially longitudinally or straight, such as shown in the embodiments discussed above with respect to FIGS. 5, 7 and 8A-8B. There typically will be at least two helical, or otherwise configured, gas flow directing grooves 322, although additional gas flow directing grooves also can be provided, including one or more substantially straight, longitudinally extending grooves, as needed depending upon the geometry or configuration of the piston body, as well as volume of gas being received by the gas redirection piston assembly. The grooves also can preclude the need to orient the piston in a particular alignment or rotational orientation within the bore in order to facilitate gas cut-off.

In use, as indicated in FIGS. 10A and 10B, the combustion gases will enter the gas expansion housing 210 via the gas port 218, as indicated by arrow 260. The gases will be received and will tend to pass about the annular recess section 316 of the gas piston body, and will tend to be directed forwardly along the helical gas flow directing grooves 322 of the second end or head portion 314 of the gas piston body toward the closed end or head 215 of the gas expansion housing, as indicated by arrows 327. As a result, when the gases reach and/or impinge against the closed end of the gas expansion housing, the gas piston 310 will be urged or forced in the direction of arrows 311 against the force of spring 251 so as to drive the connecting rod 250 rearwardly in the direction of arrow 311 to cause the opening of the chamber and discharge of a spent cartridge or shell therefrom. At substantially the same time, the movement of the combustion gases along the curved or helical gas flow directing grooves 322 also imparts a swirling or rotary movement to the combustion gases. This rotating motion of the combustion gases in turn causes the gas piston to be rotated about the central axis 319. Such rotation is indicated by arrows 328, and can be in either direction, depending upon the direction of curvature of the gas flow directing grooves 322. Such rotational movement of the gas piston can further assist in cleaning of the gas expansion housing, so as to remove debris and other deposits resulting from the influx of the combustion gases coming into the gas expansion housing.

Figure 10C:
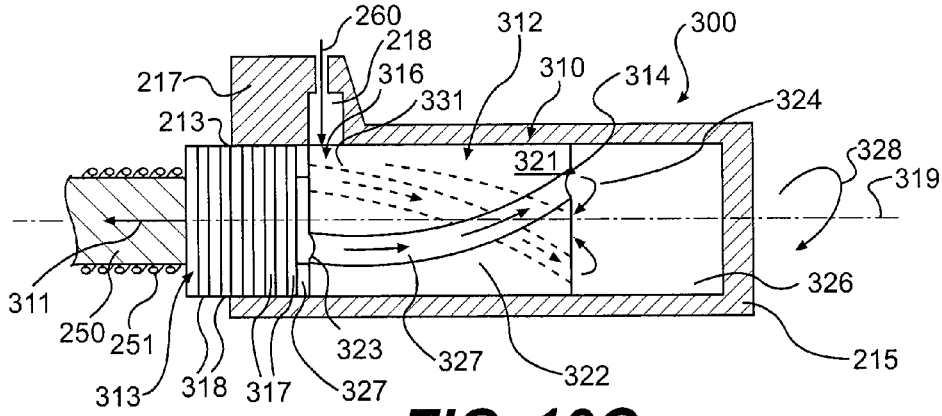

The force of the expanding combustion gases acts against the head of the piston so as to drive the gas piston rearwardly from a first or home position toward a second position as indicated by arrow 311 in FIGS. 10B-10C, overcoming the force of the spring 251 and correspondingly driving the connecting rod 250 rearwardly. This movement of the connecting rod in turn causes the bolt/breach bolt of the firearm to be translated rearwardly so as to eject the spent cartridge casing or shell after which a new cartridge or shell is "chambered." The rearward travel of the gas piston typically is defined by the front or forward edge 331 of the head portion 314 of the piston reaching its second position under force of the spring 251 about the connecting rod so as to block further movement of the gas piston rearwardly along the gas expansion housing. At this point, the piston defines an obstruction that blocks or retards further in-flow or receipt of combustion gases from the bore of the barrel, as indicated in FIG. 10C, while exhaust/combustion gases within the housing chamber further are permitted to escape the gas expansion housing to reduce gas pressure in the housing. As the combustion gases thereafter are released or exhausted from the inner bore of the gas expansion housing, the force of the spring 251 drives the connecting rod, and thus the piston, forwardly along a return stroke in the direction of arrows 311' (FIG. 10A) so as to cause the piston to be returned to its pre-firing position indicated in FIG. 10A. The controlled release of the trapped exhaust gases further helps dampen the rate of return of the piston by the spring 251 to provide a more controlled return of the piston to its pre-firing position as indicated in FIG. 10A for the completion of a firing cycle.

Figure 11A:
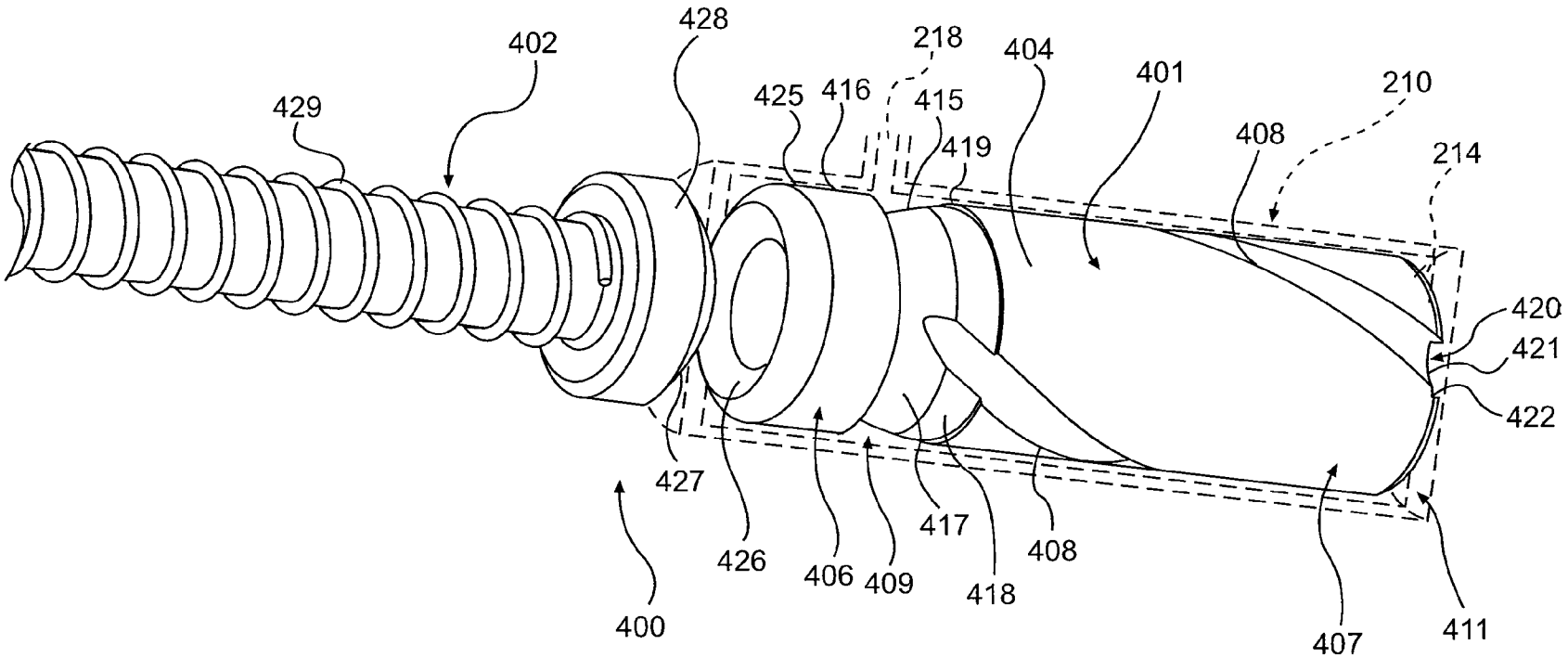
FIGS. 11A-11B are perspective views illustrating a further alternative embodiment of the gas redirecting piston and its engagement with the connecting rod of the firearm.
Figure 11B:
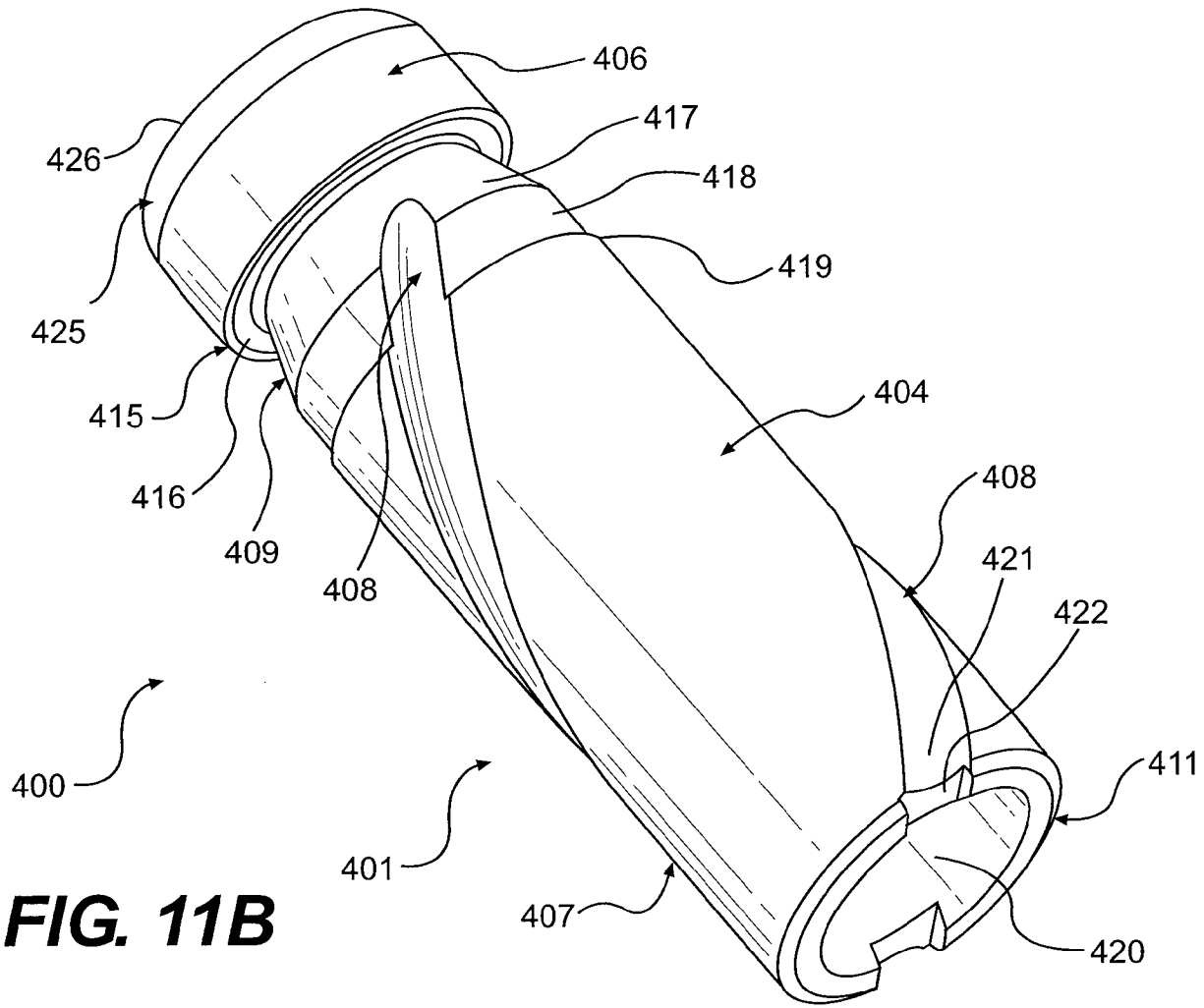

FIGS. 11A and 11B illustrate still a further embodiment of a gas redirecting piston assembly 400 for the firearm gas system according to the principles of the present invention. In this embodiment, the gas redirecting piston assembly 400 has a piston 401, which engages and meets with the connecting rod 402 of the firearm without being rigidly connected thereto so as to provide a flexible, floating union or connection, which is able to accommodate dimensional variations in the connecting rod and cast piston depending upon the type of firearm in which the gas redirecting piston assembly 400 is being used.

As indicated in FIGS. 11A and 11B, the piston 401 generally includes a piston body 404 having a leading or first proximal end 406 and a second trailing or distal second end or shank 407. A series of helical or otherwise non-linearly configured flutes or grooves 408 generally will be formed in the outer diameter or side wall of the second or trailing end 407 of the piston body, extending from an annular recess 409 to a forward end or operating head portion 411 at the trailing end 407 of the piston body. As discussed above with respect to the embodiment of FIGS. 10A-10B, the non-linear or helical grooves 408 can provide a torsion force to the gas piston, causing it to rotate under pressure of the gases moving therealong. This torsion or rotational force can help provide a self-cleaning function for the gas operating assembly by engagement of the piston body with the side walls of the bore (indicated by dash lines 214 in FIG. 11A) gas expansion housing (indicated by dash lines 210 in FIG. 11A). The grooves also preclude the need to orient the piston in a particular alignment or rotational orientation within the bore in order to facilitate gas cut-off.

As FIG. 11B illustrates, the annular 409 recess generally will be formed adjacent the first or leading end 406 of the piston body 404, and generally can comprise a substantially cylindrical or circular notch formed in the piston body. The annular recess further generally will align with the gas inlet port indicated at dash lines 218 in FIG. 11A) of the gas expansion housing of the gas redirecting piston assembly. An undercut portion 415 is formed in the forwardly facing edge 416 of the leading end of the piston body, partially circumscribed about the annular recess 409 as indicated in FIG. 11B. The undercut generally is formed facing the annular recess and can be angled from about 0° to about 45° (with possibly greater angles being formed as needed) to help promote redirection of the propellant gases received into the annular recess through the gas port toward and along the longitudinally extending grooves 408 formed in the distal or trailing end of the piston body.

The annular recess further can include a series of angled surfaces or sections, including a first angled surface or section 417 having an angle of approximately 5° to approximately 40°, although greater or lesser angles also can be used, to assist in thrust vectoring of the propellant gases toward the grooves or flutes formed in the piston body. A second, downstream surface or section 418 of the annular recess can be provided with a substantially flat or slightly angled surface, the angle of which typically can be less than the angle of the first section of the annular recess, and which defines a shoulder or edge 419 for the trailing or distal end 407 of the piston body. This shoulder helps provide a gas cutoff for the system as the piston body moves rearwardly against the connecting rod 402 and over the gas inlet port of the gas expansion housing, so as to shut off the gas flow. The shoulder also can help meter and the gas flow into the gas expansion housing as the shoulder passes over the gas inlet port so as to allow only a selected or desired amount of propellant gases into the gas expansion housing, and additionally can help provide further cleaning of the bore of the gas expansion housing as the piston 401 moves therealong. The first, angled section of the annular recess further assists in getting the gases behind the piston rather than leaking around the leading surface of the piston, operating in conjunction with the undercut to help ensure a pressure spike and substantial redirection of the gases along the longitudinal, non-linear flutes or grooves.

In this embodiment, one to four flutes or longitudinal grooves 408 generally can be used, extending in a substantially helical fashion about the trailing end 407 of the piston body 404, though other configurations or shaped grooves also can be used. The use of such helical or non-linear grooves can help reduce or substantially minimize the need to specially orient the piston in a given position for gas cutoff during operation, and the grooves further typically will be spaced equidistantly about the perimeter or circumference of the piston body so as to help provide a symmetry in gas flow therealong. As further discussed above, the spiral or helical flutes or grooves can further promote a torsion or spinning motion to the piston body which will assist in keeping the bore of the gas expansion housing clean over extended firing. As indicated in FIG. 11B, the grooves extend from the annular recess 409 along the trailing end 407 of the piston body 404 and terminate at a substantially hemispherical dimple or recess 420 formed in the forward face or end 411 of the trailing end of the piston body. The ends of the grooves 421 typically can be formed with channels or cutout portions 422 to enable or facilitate direction and rapid filling of propellant gases into the dimple 420 and against the operating head or face 411 of the piston 401 so as to promote the collection and rapid expansion of the propellant gases between the front face of the piston and the corresponding end of the gas expansion housing. This in turn causes the piston to be driven rearwardly against the connecting rod for cycling the firearm so as to eject a spent round or cartridge and load a new cartridge in the firearm chamber for continued operation.

As additionally indicated in FIG. 11A, the downstream face or edge 425 of the leading end 406 of the piston body 404 generally will be formed with a rounded outer surface and a substantially hemispherically cut concave inner or leading surface 426 adapted to interface with the operating rod 402 of the gas redirection piston assembly 400. As additionally indicated in FIG. 11A, the operating rod 402 has a corresponding or matching beveled or rounded concave surface 427 at its forward end 428, which can substantially match and/or mate with the rounded concave surface 426 of the leading end of the piston, and a compression buffer spring 429 or similar biasing member extending along its length behind the forward end of the operating rod. As a result, a matching or mating engagement is provided between the connecting rod 402 and the leading end 406 of the piston enables a strong but flexible engagement or union between the connecting rod and the piston during operation, without requiring a rigid, fixed connection between the connecting rod and piston. This flexible connection consequently enables relative motion and realignment between the parts during operation to accommodate dimensional variations in the operating rod and/or piston body over long lengths, including providing a self-centering feature when the system is under pressure. The flexible connection between the piston and connecting rod and further can assist in the use of conversion or upgrade of a firearm to gas piston operation, as only the barrel, bolt carrier and gas piston assembly or system need to be replaced to upgrade a firearm to gas piston operation using the gas operating system of the present invention.

As additionally indicated in FIG. 11A, a central channel or passage further generally is formed, extending at least partially along the piston body and having an open end found at the convex mating surface of the leading end of the piston body. A spring (not shown) can be received within the central channel as needed or desired, with one end thereof extending into and engaging the end of the channel within the piston body, while the other end of the spring generally will engage the connecting rod for returning the piston back to its retracted, non-operative position, ready for a subsequent firing operation.

As noted previously, during a firing operation, the piston moves rearwardly along a gas expansion chamber of the gas operating system by pressure of the combustion gases operating between the dimpled front face at the distal or front end of the gas piston and a rigidly fixed gas plug at the front end of the gas block. The piston is driven rearwardly, against the operating rod, and as the gas piston/operating rod move rearwardly, the operating rod will engage the bolt carrier, causing it to move rearwardly for cycling of the bolt of the rifle. After a desired distance of rearward travel, the gas port and inlet of the gas expansion housing are closed off by the piston, cutting off the flow of gases moving in and allowing the bolt and piston to begin decelerating under the biasing force of the buffer spring 429 and thereafter enabling the bolt to reverse direction under the force of the buffer spring 429. The compression spring within the piston helps maintain a forward force against the operating rod, maintaining contact between the operating rod and gas piston during the return cycle. Additionally, the length and location of the reduced diameter or first angled section 417 in the annular recess 409 and/or the shank or trailing end 407 of the piston body further can help regulate the amount of piston travel, and thus the time before the propellant gases are cut off or allowed to bleed out of the gas expansion housing.

The gas redirecting piston assembly 400 of the present embodiment further generally will be formed with a diameter and/or shape or configuration substantially corresponding to the diameter or configuration of the bore of the gas expansion housing. The leading end of the piston body can be held to closer tolerances or greater precision in terms of substantially matching the diameter of the gas expansion housing, while the shank or trailing end of the piston body can be formed with less precision and/or slightly greater tolerances between its body and the wall of the gas expansion housing. Thus, the leading end of the piston body can provide a functional gas seal with respect to the inner wall of the bore of the gas expansion housing, while providing dimensional concessions to the bore of the gas expansion housing, i.e., being out of round, surface variations, cylindrical variations, etc., along the shank or trailing portion of the piston body. As a result, additional mechanical seals generally are not required to be used with the present embodiment of the gas piston assembly, although such seals can be used, and thus additional wear problems, such as the wear of ring seals moving against the gas block, which can result in increased gas leakage with use can be substantially minimized.

Figure 12:
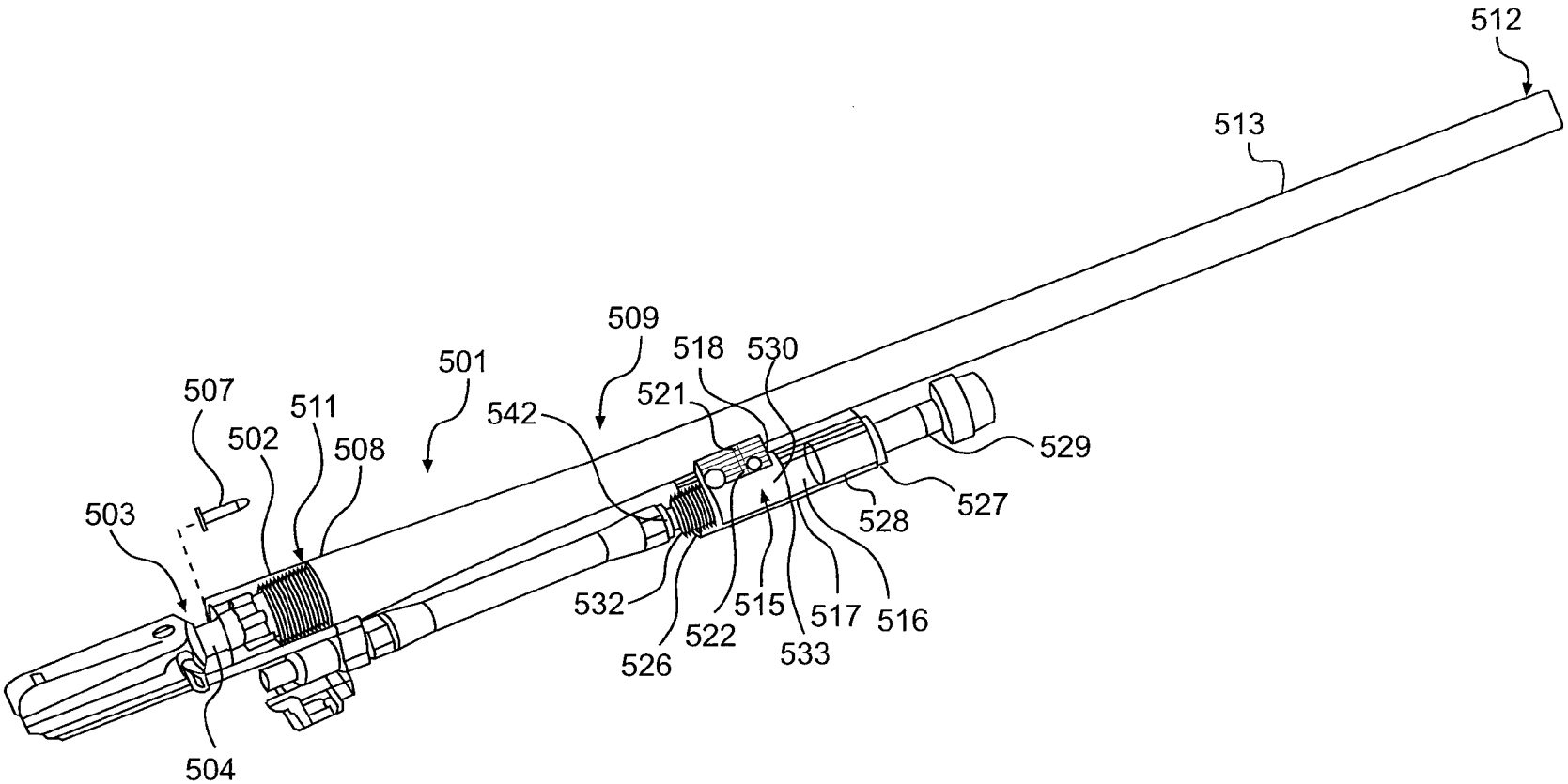
FIG. 12 is a side view illustrating yet another alternative embodiment of the gas redirecting piston assembly.

FIGS. 12-14B illustrate still a further embodiment of the gas redirecting piston assembly 500 for a firearm 501 according to the principles of the present invention. As illustrated in FIG. 12, the firearm 501 generally includes a chassis 502 or frame, including an upper receiver portion 503. The receiver 503 includes a bolt assembly 504 carrying a firing pin into engagement with a round of ammunition 507 that is received and contained within the chamber 508 of the barrel 509 and is operable by a fire control such as a trigger assembly as discussed above. As FIG. 12 also illustrates, the barrel 509 generally includes a breach end 511 at which the chamber 508 is formed, and a muzzle 512 at the opposite end, with a longitudinally extending barrel bore 513 defined therebetween. An accessory rail system (not shown) further can be mounted to the chassis of the firearm, extending over the receiver 503 and barrel in a covering arrangement.

Figure 13:
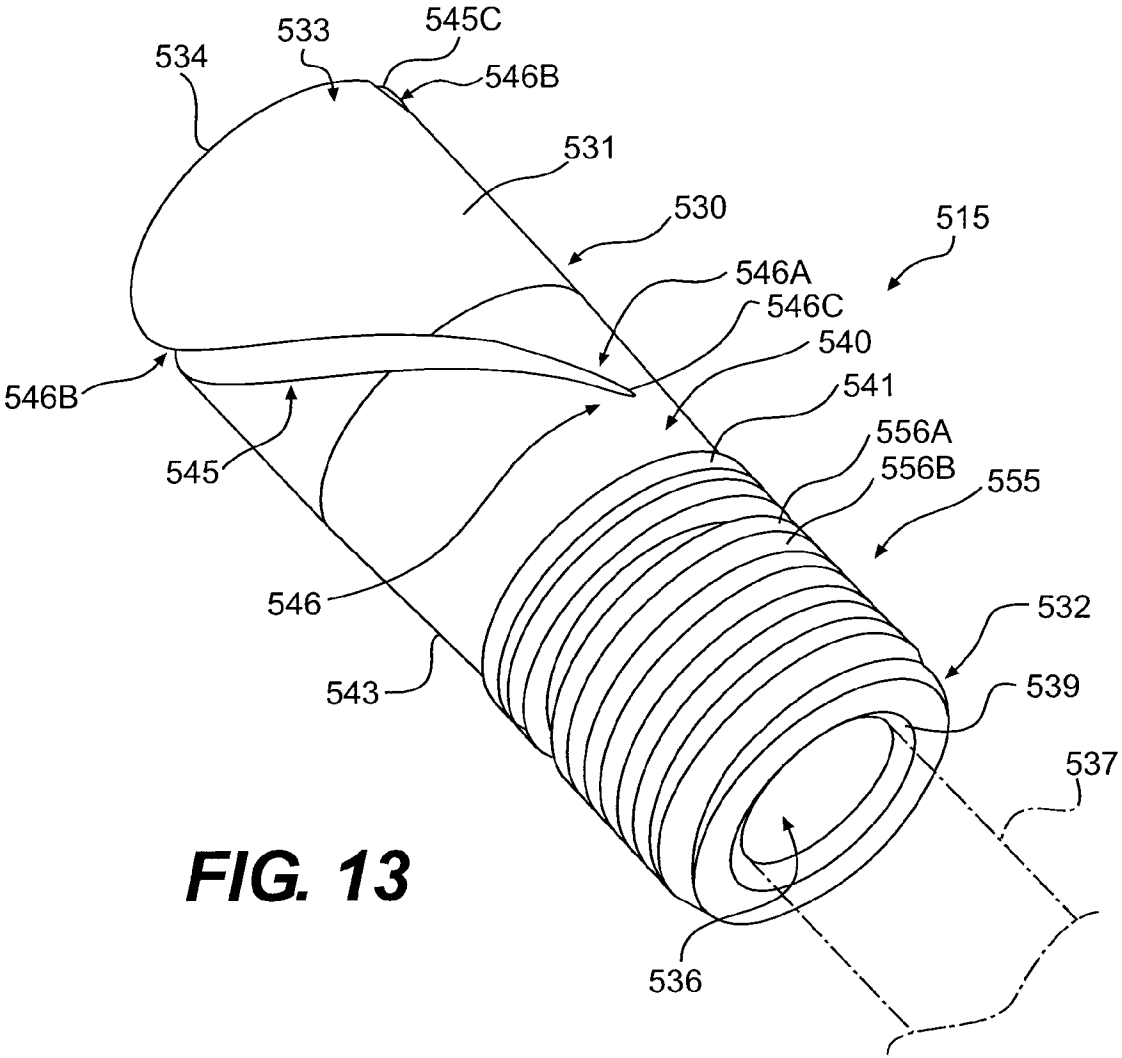
FIG. 13 is a perspective illustration of the piston of the embodiment of FIG. 12.
Figure 14A:
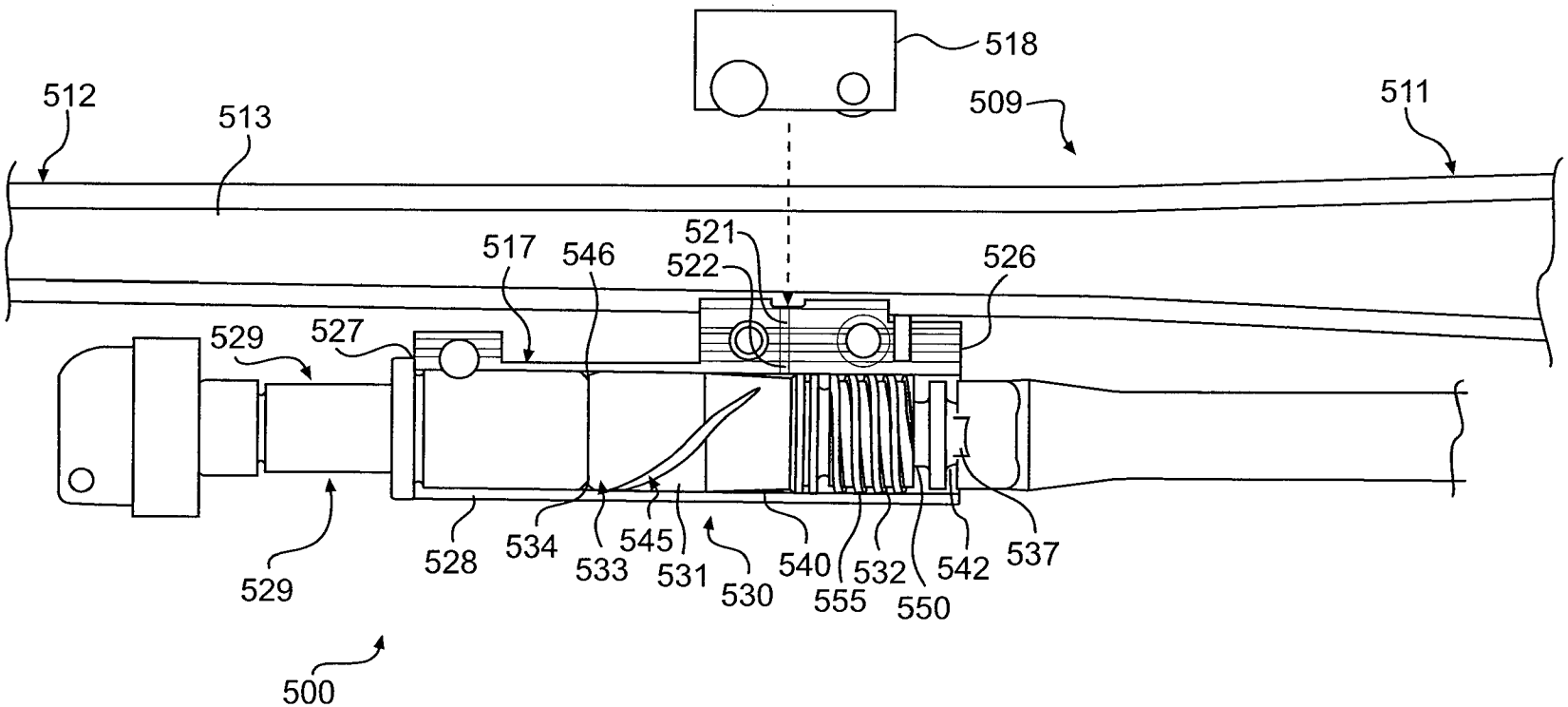
FIGS. 14A-14B are side views of the piston and gas expansion housing of the embodiment of FIG. 12 in operation, shown in partial cross-section.
Figure 14B:
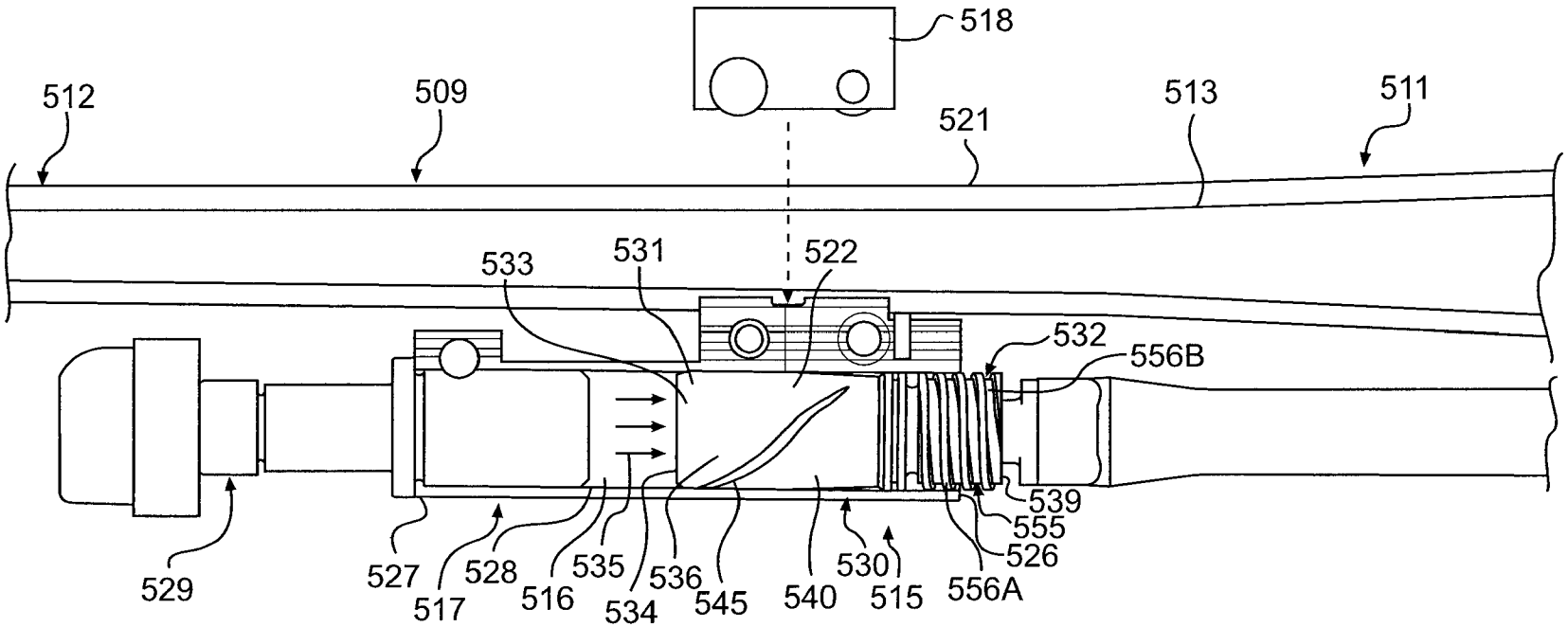

In this embodiment, the gas redirecting piston assembly 500 according to the present embodiment includes a piston 515 (FIG. 13) moveable along a piston bore 516 (FIGS. 14A-14B) of a gas expansion housing 517, which generally is shown in the present embodiment as being mounted below the barrel (though it could be mounted in other alignments), such as by a clamping gas block 518. The gas expansion housing is in communication with the bore 513 of the barrel 509 via a gas port 521 that extends between the barrel bore 513 and a corresponding gas inlet or channel 522 of the gas expansion housing 517. As indicated in FIGS. 14A-B, the gas expansion housing 517 generally includes an open first, downstream end 526, a second, upstream, closed end 527 and defines the longitudinally extending passageway or piston bore 516 having a side wall 528 therebetween. As indicated in FIGS. 12 and 14A-B, a gas plug 529 generally can be received within the second end 527 of the gas expansion housing 517 so as to substantially seal or close off the second end of the gas expansion housing. The gas plug typically will be removable to enable cleaning of the piston bore and piston of carbon, dust and other by-products of the combustion gases generated upon firing and which can build up over use within the gas redirecting piston assembly.

The piston 515 is received within the piston bore 516 of the gas expansion housing 517 and is moveable therealong. The piston 515 generally has a configuration substantially similar to the configuration of the side wall of the piston bore 516 of the gas expansion housing, i.e., cylindrical, rectangular, etc. to facilitate close sliding movement of the piston therealong. As illustrated in FIGS. 13-14B, the piston 515 generally includes a piston body 530 having a side wall 531, a first end 532 adjacent the first end 526 of the gas expansion housing, and a closed second end or head 533 facing the gas plug 529. The second end 533 of the piston 515 can have a substantially flat or slightly concave facing surface 534 (FIG. 13), against which the combustion gases generated upon firing that pass into gas expansion housing from the barrel of the firearm will be directed, as indicated by arrows 535 in FIG. 14B. The first end 532 of the piston body 530 generally can be open, defining an interior channel or bore 536, that extends through the piston body in which a spring biased rod 537, shown in phantom lines in FIG. 13, can be received if needed. This first end 532 of the piston body further can include a chamfered or beveled edge 539 circumscribed about its inner surface leading into the bore 536.

Additionally, as shown in FIG. 13, an intermediate section or portion 540 can be formed along the piston body 531 between the first and second ends 532 and 533, thereof. This intermediate section 540 can have a tapered or reduced diameter configuration so as to angle or taper slightly inwardly from the second end 533 toward the first end 532 of the piston body 530. A downstream band or circular ridge defining a shoulder portion 541 generally will be formed between the intermediate section 540 and the first end portion 532 of the piston body. The shoulder can help provide a gas cutoff for the system as the piston body moves rearwardly against a connecting or operating rod 542 (FIGS. 14A-14B) of the firearm.

The shoulder also can help meter the gas flow into the gas expansion housing as the shoulder passes by the gas inlet port so as to allow only a selected or desired amount of the propellant gases into the gas expansion housing, and additionally can further provide help in cleaning the bore of the gas expansion housing as the piston moves therealong. The angled sides or edges 543 of the shoulder 541 further can assist in getting or directing the gases behind the piston rather than leaking around the leading surface of the piston, operating in conjunction with the reduced or tapered diameter of the intermediate portion of the piston body to help ensure substantial redirection of the gases along a series of longitudinally extending non-linear flutes or grooves 545 formed along the piston body.

As shown in FIGS. 13-14B, the series of non-linear grooves 545 can be formed at least partially along the outer surface or wall 531 of the piston body 530. While the two non-longitudinal grooves generally are shown in the Figures, it will be understood that more than two, i.e., three-four or more grooves can be used, or a single groove can be provided as needed or desired. The grooves can provide a torsion force to the gas piston, causing it to rotate under pressure of the gases moving therealong. This torsion or rotational force can help provide a self-cleaning function for the gas operating assembly by engagement of the piston body with the side walls of the piston bore, as indicated in FIG. 14, so as to help facilitate removal and/or prevent excessive build-up of combustion materials such as carbon and other debris along the piston bore of the gas expansion housing.

As indicated in FIGS. 13-14B, the grooves generally can extend from a point or location such as indicated at 546 along the intermediate portion 540 of the piston body rearwardly to the facing surface 534 of the second end 533 of the piston body 531. The terminating ends 545A and 545B of the grooves or flutes 545 also typically can be formed with reduced or graduated portions 545C so as to facilitate or enable direction and rapid filling of propellant gases therealong for directing the gases rearwardly toward the operating head or facing surface 534 of the piston body. In turn, this can help promote the collection and rapid expansion of the propellant gases between the facing surface of the second end of the piston and the gas plug 529 (FIGS. 12 and 14A-B), which in turn causes the piston to be driven rearwardly against the connecting rod or operating rod 542 (FIG. 14A) of the firearm for cycling the firearm so as to eject a spent round or cartridge and load a new cartridge in the firearm chamber for continued operation.

The downstream edge or face 550 of the operating or connecting rod 542 can be formed with a rounded or substantially convex leading surface adapted to interface with the rod 537 received within the piston body. The rounded or convex surface of the operating rod face generally is adapted to correspond or substantially match a beveled or rounded concave surface of the rod such that a matched or mating engagement can be provided between the connecting or operating rod and the leading end or first end of the piston that enables a strong but flexible engagement or union between these parts during a firing operation, without requiring a rigid, fixed connection therebetween. This flexible connection further facilitates realignment or adjustment to accommodate for dimensional variations between the operating rod and/or piston body, especially over varying lengths thereof and including providing a substantially self-centering feature when the system is under pressure. As also previously noted, the flexible connection between the piston body and firearm connecting rod further can assist in a conversion or upgrade of a firearm to a gas piston operation, as only the barrel, bolt carrier and gas piston assembly or system would need to be replaced to upgrade the firearm to a gas piston operation using the gas operating system of the present invention.

Upon firing, as discussed with respect to the embodiments above, combustion gases are directed or bled off through from the barrel bore through the gas port 521 (FIGS. 14A-14B) and into the gas inlet 522 for the gas expansion housing 517 of the gas redirecting piston assembly 500. As indicated in FIG. 14A, the gases are directed in the direction of arrows 535 along the gas expansion housing and along the longitudinally extending non-linear grooves 545 toward the facing surface or operating head 534 of the piston body. The gases are received between the facing surface of the piston body and the gas plug 529 and, as the gases continue to expand, they drive the piston body rearwardly along the piston bore 516 of the gas expansion housing. This rearward movement of the piston body drives the operating rod rearwardly as the piston is moved against the force of the compression spring biased rod 537 (FIG. 13) received within its central bore 536 in order to cause the ejection of a spent cartridge or shell and the loading of a new cartridge or shell into the chamber of the barrel. As the downstream or second end portion of the piston body approaches the first end of the gas expansion housing, the flow of gas into the bore is substantially reduced and/or bled off such that the compression spring eventually overcomes the remaining force of the gas driving the piston and acts to stop further travel of the piston between its initial or first position pre-firing and its second, extended position after firing. Thereafter, the spring biased rod helps return the piston to its initial position within the gas expansion housing, completing the loading of a new round of ammunition in the chamber of the barrel and resetting the bolt of the firearm for a next firing operation.

In addition, as indicated in FIGS. 13-14B, an annular seal 555 generally is formed about the piston body. The annular gas seal typically is a turbulent gas seal, which is shown as including a series of spaced, parallel ridges 556A and grooves 556B, that can help create a mechanically efficient piston seal in a manner as understood in the fluid arts. It will also be understood that additional, alternative seals can be used. Still further, the longitudinally extending, non-linear grooves 545 can further help preclude the need for the piston body to be fixed in a necessary or particular orientation within the gas expansion housing in order to facilitate gas cutoff. Rather, the grooves 545 can help provide a self-centering function to enable the piston body to functionally cut off the incoming gas flow as needed.

The gas operating system utilizing the gas redirecting piston assembly according to the present invention generally will accommodate barrel lengths from pistol lengths (i.e., less than about 10.5 inches) to rifle lengths (i.e., greater than about 14 inches). The gas operating system also can be configured to be unadjustable, and/or adjustable as needed to accommodate effects of a suppressor such as through the application of user selectable orifices. The gas operating system additionally does not necessarily require or include a hard stop for the motion of the piston and operating rod, but instead enables the use of the action buffer spring of the firearm to slow the component's motion and return the piston to a rest position. Alternatively, a separate forward assist spring engaging the operating rod and piston also can be used to help provide substantially constant contact between the operating rod and gas piston throughout a firing cycle. Additionally, the operating rod can be intermittently linked to the bolt carrier of the firearm via monolithic carrier block via concave and convex mating surfaces on the operating rod and carrier block, in similar fashion to the convex and concave mating surfaces between the operating rod and gas piston. Such a connection can enable further flexibility and interchangeability of components with the gas operating system of the present invention. Still further, while the gas redirecting piston assembly is shown mounted below the barrel of a firearm, it can also be mounted in other arrangements such as above the barrel, as for use in an MR or AR-15 style firearm.

It therefore can be seen that the construction of the gas redirecting piston assembly according to the principles of the present invention addresses the problems inherent in the prior art constructions of gas-operated firearms. For example, the gas redirecting piston assembly of the present invention can enable the gas port(s), or duct(s), which divert the expanding propellant gases from the barrel, to be situated closer to the chamber of the firearm. This provides the ability to recoup greater energy/work from the higher pressure of the expanding gases from firing.

The corresponding structures, materials, acts and equivalents of any means plus function elements in any of the claims below are intended to include any structure, material, or acts for performing the function in combination with other claim elements as specifically claimed.

Those skilled in the art will appreciate that many modifications to the exemplary embodiments are possible without departing from the spirit and scope of the present invention. In addition, it is possible to use some of the features of the present invention without the corresponding use of the other features. Accordingly, the foregoing description of the exemplary embodiments is provided for the purpose of illustrating the principles of the present invention and not in limitation thereof since the scope of the present invention is defined by the appended claims.

What is claimed is:

1. A firearm having a gas operating system, comprising:

a barrel having a cartridge chamber and bore;

a gas expansion housing located adjacent the barrel;

a chamber located along the gas expansion housing and in flow communication with the bore of the barrel;

a gas flow metering piston received along the chamber of the gas expansion housing and including a piston body having a first end and a second end, the metering piston moveable between a first position along the chamber wherein a flow of gas can pass from the barrel bore into the chamber of the gas expansion housing, and a second position wherein the piston defines an obstruction of the flow of gas from the barrel bore into the chamber of the gas expansion housing for regulating the incoming flow of gas received in the chamber of the gas expansion housing from the barrel bore;

wherein the piston further comprises at least one longitudinal groove formed along the piston body and defining a gas flow path therealong, the at least one longitudinal groove being formed in the piston body in a substantially helical manner about a cylindrical axis of the piston.

2. The firearm of claim 1, wherein when the piston is in its first position, pressurized gas is received in the chamber from the bore and engages a surface of the piston with sufficient force to move the piston between its first position and its second position.

3. The firearm of claim 1, and further comprising at least one port bridging the bore of the barrel and the chamber of the gas expansion housing, enabling passage of gas therebetween.

4. The firearm of claim 1, wherein the piston comprises a recessed section defined between its ends at which gas is received via at least one gas flow communication port when the piston is in its first position.

5. The firearm of claim 4, wherein the piston body obstructs the gas flow communication port when the piston is in its second position.

6. The firearm of claim 4, wherein the gas flow path extends between the first end of the piston and the recessed section of the piston, for enabling gas flow passage along the piston, and the piston body further comprises a pressure bearing area defined at the first end of the piston upon which the gas acts to displace the piston.

7. The firearm of claim 1, wherein the piston is substantially cylindrically shaped, having an axis concentric with a vector defined by the first and second positions of the piston.

8. The firearm gas piston assembly of claim 1, wherein the piston comprises at least one groove formed around a cylindrical axis of the piston, and wherein the piston defines turbulent gas seals that retard gas leakage between the piston and gas expansion housing cylinder during the piston's displacement between its first and second positions.

9. The firearm gas piston assembly of claim 1, and further comprising a mechanical sealing mechanism received within a groove formed about a cylindrical axis of the piston to retard gas leakage between the piston and gas expansion housing cylinder during the piston's displacement between its first and second positions.

10. The firearm gas piston assembly of claim 1, wherein movement of the piston from its first position to its second position facilitates the unlocking of a bolt of the firearm, allowing the bolt to translate towards a butt of the gun after detonation of a cartridge in the barrel chamber.

11. A gas redirecting piston assembly for a gas-operated firearm of the type having a chamber adapted to receive a cartridge and a barrel, the gas redirecting piston assembly comprising:

a gas expansion housing defining an inner bore and having a gas port extending therethrough and into communication with a gas duct formed through the barrel and located proximate the chamber of the barrel of the firearm;

a gas flow metering piston slideably received within the inner bore of the gas expansion housing, and having a first end through which a connecting rod is received, a second end, an outer wall, having a recessed section of a selected depth formed at a location spaced between the first and second ends of the piston for receiving a gas flow volume therein, and at least one gas flow directing groove formed in the outer wall of the piston and extending approximately from the recessed section toward the second end of the piston so as to define at least one pathway for redirecting portions of gases from firing forwardly along the bore of the gas expansion housing from the gas port thereof into engagement with the head of the piston;

wherein upon firing, a flow of pressurized gases generated from firing are diverted through the gas port and along the at least one longitudinally extending groove of the piston, whereupon the pressurized gases are directed against the first end of the piston so as to drive the piston axially from a first, retracted position within the housing to a second, extended position.

12. The gas redirecting piston assembly of claim 11, wherein the at least one gas flow directing groove formed along the piston comprises a plurality of helical gas flow directing grooves, arranged in spaced series about the outer wall of the piston.

13. The gas redirecting piston assembly of claim 12, wherein the piston comprises at least two similarly formed and dimensioned helically extending grooves.

14. The gas redirecting piston assembly of claim 11, and wherein the second end of the piston comprises a dimension substantially equivalent to the inner bore of the gas expansion housing so as to define a turbulent gas seal.

15. The gas redirecting piston assembly of claim 11, wherein the piston further comprises a turbulent gas seal having a tubular member having a series of spaced annular ridges and grooves formed thereabout, with at least one flexible gas seal received in at least one of the spaced grooves formed about the tubular member.

16. The gas redirecting piston assembly of claim 11, and wherein the gas duct is positioned approximately 2 to approximately 10 inches from a rear end of the chamber of the firearm.

17. The gas redirecting piston assembly of claim 11, wherein when the piston is in its extended position, the outer cylindrical wall of the piston at least partially blocks the flow of gases from the gas port into the gas expansion housing.

18. A gas-operated firearm for automatically loading a next round of ammunition after firing, comprising:

a bolt;

a chamber;

a barrel;

a gas expansion housing defining an inner bore and having a gas port adjacent the chamber and extending through the expansion housing and communicating with the inner bore and the barrel for receiving and diverting exhaust gases from the barrel to the inner bore;

a gas duct extending between the barrel and the gas port of the gas expansion housing;

a piston slideably received within the inner bore of the gas expansion housing, the piston comprising:

a piston body having first end portion, a second end portion spaced from the first end and having an outer wall defining, and an intermediate section extending between the first and second end portions;

a connecting rod received within and extending along the piston body;

at least one gas flow directing groove formed in the outer wall of the piston and extending from the intermediate section to the second end of the piston for directing the exhaust gas from the intermediate section to a point adapted to impinge against the head of the piston;

wherein the intermediate section is formed with a reduced diameter defining an annular recess adjacent the first end of the piston and adapted to receive exhaust gases diverted from the barrel upon firing through the gas duct and gas port; and wherein pressurized exhaust gases are diverted from the barrel through the gas port of the gas expansion housing and into the annular recess, whereupon the exhaust gas is enabled to expand as it flows along the at least one gas flow directing groove toward the second end of the piston, whereupon the pressurized exhaust gas is directed against the second end of the piston and urges the piston axially along the expansion housing from a first position to a second, extended position for cycling the bolt of the firearm to load the next round of ammunition in the chamber of the firearm.

19. The firearm of claim 18, wherein the at least one gas flow directing groove comprises a plurality of substantially straight longitudinally extending grooves spaced about the outer wall of the piston.

20. The firearm of claim 18, wherein the at least one gas flow directing groove comprises at least one helically extending groove.

21. The firearm of claim 18, and wherein the connecting rod comprises a convex mating surface, adapted to engage a concave mating surface formed at the first end of the piston in a bearing relationship during firing.

22. The firearm of claim 18, and wherein the gas duct is located between approximately 2 inches and approximately 8 inches from a rear end of the chamber.

23. The firearm of claim 18, further comprising a gas seal proximate the first end of the piston.

24. The firearm of claim 23, wherein the gas seal comprises a tubular member having a series of spaced annular ridges and grooves formed thereabout, with at least one flexible seal received in at least one of the grooves.

25. The firearm of claim 23, wherein the gas seal comprises at least one mechanical seal mounted adjacent the first end of the piston.

26. The firearm of claim 18, wherein when the piston is in its extended position, the outer cylindrical wall of the piston substantially restricts a flow of the exhaust gas from the gas port into the inner bore of the gas expansion housing.

27. The firearm of claim 18, further comprising at least one slot formed proximate the first open end of the piston and in communication with the annular recess, wherein when the piston is moved to its extended position, then at least one slot extends outwardly from the housing to define a vent for escape of the exhaust gas from the expansion housing.

28. The firearm of claim 18, and wherein said piston comprises a stop defined adjacent the first end of the piston and adapted to engage a corresponding bearing surface of the gas expansion housing to limit the axial movement of the piston rearwardly along the gas expansion housing.

29. The firearm of claim 18, and further comprising a biasing member in communication with said connecting rod for urging said connecting rod against said piston, wherein after firing, as said piston moves along said inner bore of said gas expansion housing, said biasing member and said connecting rod act as a stop for resisting travel of said piston beyond said second position thereof.

* * * * *